US008783357B2

(12) United States Patent
Coppedge et al.

(10) Patent No.: US 8,783,357 B2
(45) Date of Patent: Jul. 22, 2014

(54) SUBSEA WELL SAFING SYSTEM

(75) Inventors: Charles Don Coppedge, Houston, TX (US); Dana Karl Kelley, Friendswood, TX (US); Charles C. Porter, Houston, TX (US); Hildebrand Argie Rumann, League City, TX (US)

(73) Assignee: Bastion Technologies, Inc., Houston, TX (US)

( * ) Notice: Subject to any disclaimer, the term of this patent is extended or adjusted under 35 U.S.C. 154(b) by 108 days.

(21) Appl. No.: 13/220,593

(22) Filed: Aug. 29, 2011

(65) Prior Publication Data

US 2012/0048566 A1 Mar. 1, 2012

Related U.S. Application Data

(60) Provisional application No. 61/377,851, filed on Aug. 27, 2010.

(51) Int. Cl.
*E21B 29/12* (2006.01)

(52) U.S. Cl.
USPC ..... 166/340; 166/361; 166/365

(58) Field of Classification Search
CPC ..... E21B 33/038; E21B 29/12
USPC ..... 166/338, 340, 352, 359, 361, 363, 364, 166/365, 297, 298, 377, 55, 85.1
See application file for complete search history.

(56) References Cited

U.S. PATENT DOCUMENTS

| | | | | |
|---|---|---|---|---|
| 4,376,467 | A * | 3/1983 | Allen | 175/7 |
| 6,269,883 | B1 * | 8/2001 | Gissler et al. | 166/340 |
| 2004/0003926 | A1 * | 1/2004 | Nivens et al. | 166/340 |
| 2005/0061499 | A1 * | 3/2005 | Hopper | 166/84.3 |
| 2006/0151175 | A1 * | 7/2006 | Sundararajan et al. | 166/338 |
| 2007/0137866 | A1 | 6/2007 | Ravensbergen | |
| 2008/0105435 | A1 * | 5/2008 | Inderberg | 166/363 |
| 2011/0284237 | A1 * | 11/2011 | Baugh | 166/365 |

OTHER PUBLICATIONS

International Search Report and Written Opinion, PCT/US2011/049610, dated Jan. 31, 2012, 13 pages.

* cited by examiner

*Primary Examiner* — Matthew Buck
*Assistant Examiner* — Stacy Warren
(74) *Attorney, Agent, or Firm* — Winstead PC

(57) ABSTRACT

A subsea well safing method and apparatus adapted to secure a subsea well in the event of a perceived blowout in a manner to mitigate the environmental damage and the physical damage to the subsea wellhead equipment to promote the ability to reconnect and recover control of the well. The safing assembly is adapted to connect the marine riser to the BOP stack. Pursuant to a safing sequence, the well tubular is secured in the upper and lower safing assemblies and the tubular is then sheared between the locations at which it has been secured. Subsequently, an ejection device is actuated to physically separate the upper safing assembly and connected marine riser from the lower safing assembly that is connected to the BOP stack.

20 Claims, 20 Drawing Sheets

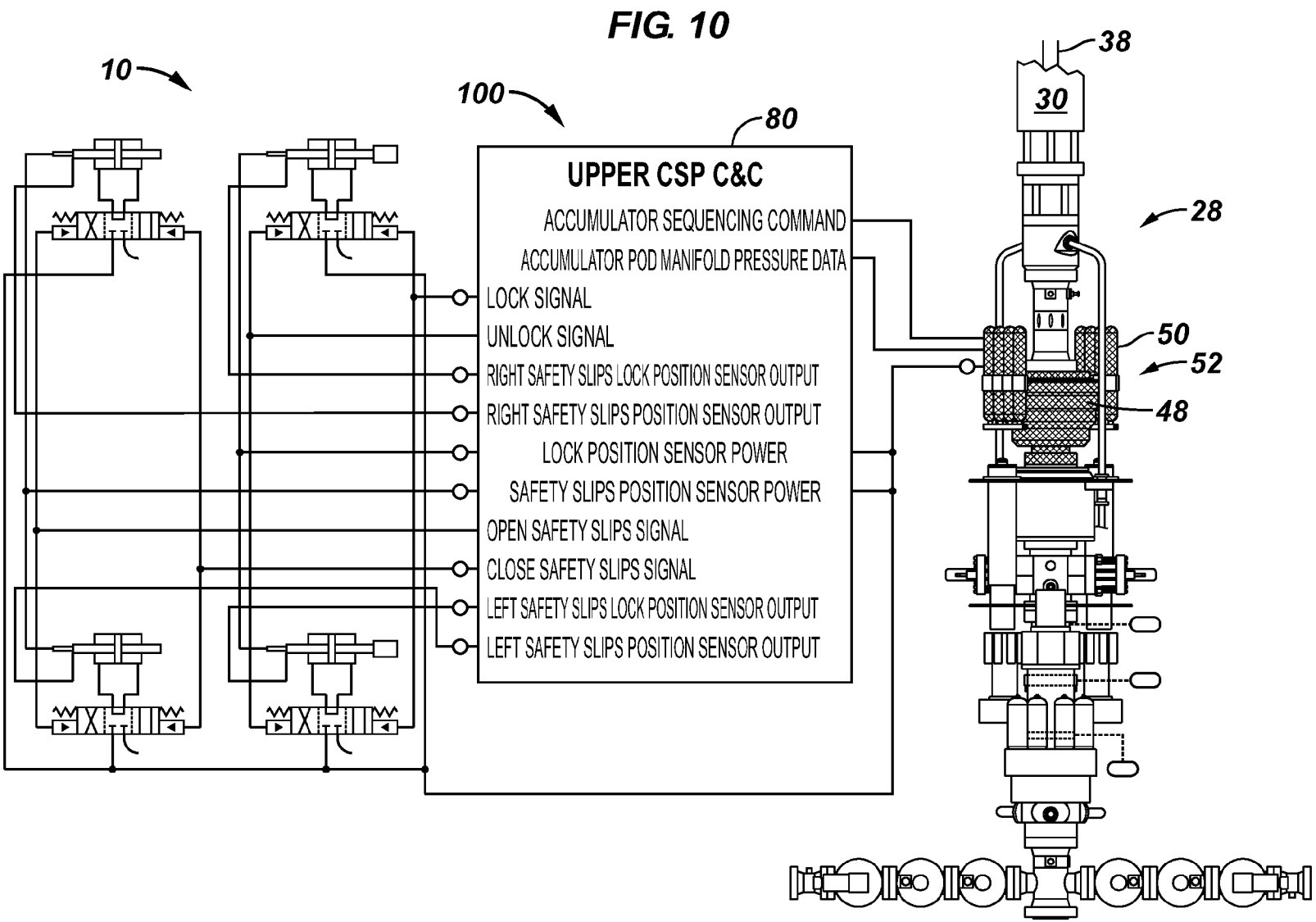
FIG. 10
UPPER CSP C&C
ACCUMULATOR SEQUENCING COMMAND
ACCUMULATOR POD MANIFOLD PRESSURE DATA
LOCK SIGNAL
UNLOCK SIGNAL
RIGHT SAFETY SLIPS LOCK POSITION SENSOR OUTPUT
RIGHT SAFETY SLIPS POSITION SENSOR OUTPUT
LOCK POSITION SENSOR POWER
SAFETY SLIPS POSITION SENSOR POWER
OPEN SAFETY SLIPS SIGNAL
CLOSE SAFETY SLIPS SIGNAL
LEFT SAFETY SLIPS LOCK POSITION SENSOR OUTPUT
LEFT SAFETY SLIPS POSITION SENSOR OUTPUT
100
80
10
28
38
30
50
52
48

SUBSEA WELL SAFING SYSTEM

RELATED APPLICATIONS

This application claims the benefit of U.S. provisional patent application No. 61/377,851 which was filed on Aug. 27, 2010.

BACKGROUND

This section provides background information to facilitate a better understanding of the various aspects of the invention. It should be understood that the statements in this section of this document are to be read in this light, and not as admissions of prior art.

The invention relates in general to wellbore operations and more particular to safety devices and methods to seal, control and monitor subsea oil and gas wells. A blowout preventer is a large, specialized valve used to seal, control and monitor oil and gas wells. Blowout preventers are designed to cope with extreme erratic pressures and uncontrolled flow (formation kick) emanating from a well reservoir during drilling. Kicks can lead to the uncontrolled release of oil and/or gas from a well resulting in a potentially subsea well event known as a blowout. Blowout preventers are critical to the safety of crew, rig (the equipment system used to drill a wellbore) and environment, and to the monitoring and maintenance of well integrity. While blowout preventers are intended to be fail-safe devices, accidents may still occur if the blowout preventer fails to properly operate. For example, during the Apr. 20, 2010, Deepwater Horizon drilling rig explosion, it is believed that the blowout preventers may not have properly operated and/or were not activated in a timely fashion. In addition, due to the failure the wellhead equipment was damaged creating additional obstacles to recovering control of the well.

SUMMARY

According to one or more aspects of the invention, a subsea well safing package for installing on a blowout preventer stack on a subsea well comprises a safing assembly connector interconnecting a lower assembly and an upper safing assembly, the safing assembly connector operable to a disconnected position, wherein the lower safing assembly is adapted to be connected to a blowout preventer stack on a subsea well and the upper safing assembly is adapted to be connected to a marine riser; the lower assembly comprising lower slips to engage a tubular suspended in a bore formed through the lower and the upper safing assemblies; the upper safing package comprising upper slips operable to engage the tubular; and a shear positioned between the upper slips and the lower slips, the shear operable to shear the tubular.

A subsea well safing system according to one or more aspects of the invention comprises a safing assembly comprising a lower safing assembly connected to a blowout preventer stack connected to a subsea well and an upper safing assembly connected to a marine riser; a safing assembly connector interconnecting the lower safing assembly and the upper safing assembly providing a bore therethrough in communication with the marine riser and the well; and an ejector device connected between the upper safing assembly and the lower safing assembly, the ejector device operable to physically separate the upper assembly and connected marine riser from the lower safing assembly.

According to one or more aspects of the invention, a subsea well safing sequence comprises utilizing a safing assembly installed between a blowout preventer stack of a subsea well and a marine riser, the safing assembly comprising a lower safing assembly connected to the blowout preventer stack and an upper safing assembly connected to the marine riser forming a bore between the riser and the blowout preventer stack; securing a tubular suspended in the bore at a position in the lower safing assembly; securing the tubular at a position in the upper safing assembly; shearing the tubular in the bore between the position in the lower safing assembly and the position in the upper safing assembly at which the tubular has been secured; and physically separating the upper safing assembly and the connected marine riser from the lower safing assembly connected to the blowout preventer stack.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

FIGS. 5-17 are schematic diagrams of safing sequence steps according to one or more embodiments of the subsea well safing system.

DETAILED DESCRIPTION

Figure 1:
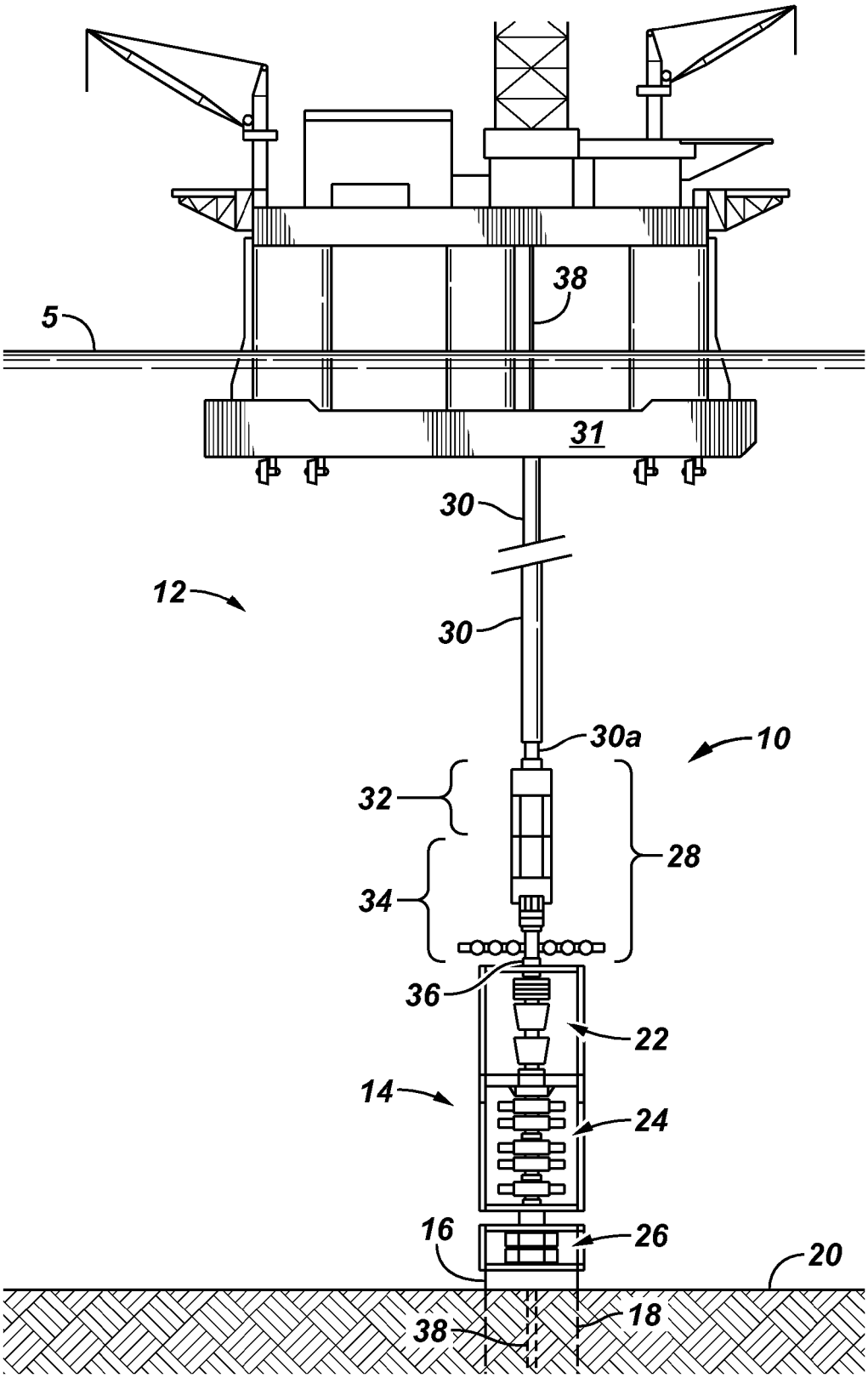
FIG. 1 a schematic illustration of a subsea safing system according to one or more aspects of the invention utilized in a subsea well drilling system.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. More-over, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled may include certain arrangements where fluid may not flow between the items, but the fluid pressure may nonetheless be transmitted. Thus, fluid communication is a subset of hydraulically coupled.

A subsea well safing system is disclosed to provide a means for mitigating the environmental and economic damage that can result from the loss of control of a well, such as occurred in the Macondo well being drilled from the Deepwater Horizon on 20 Apr. 2010. According to one or more aspects of the invention, the subsea well safing system provides a mechanism to separate the riser from the blowout preventer stack and the well in a manner intended to limit the physical damage to the well drilling system and to enhance the potential for successfully reconnecting to the well, for example via BOP stack, to regain control of the well.

FIG. 1 is a schematic illustration of a subsea well safing system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26. As will be understood by those skilled in the art with benefit of this disclosure, BOP stack 14 is not limited to the devices depicted.

Figure 2:
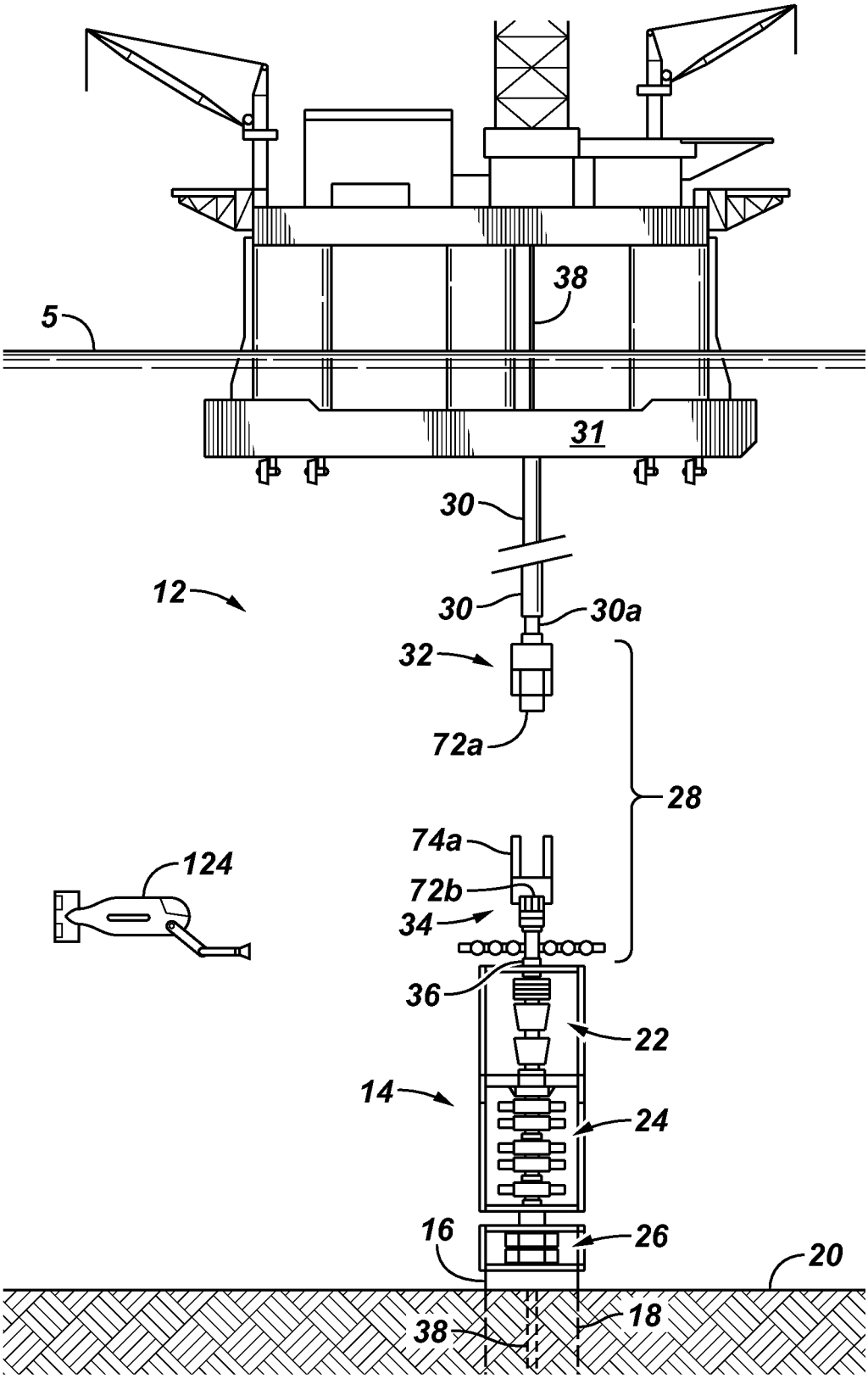
FIG. 2 depicts a subsea safing system according to one or more aspects of the invention, wherein the safing sequence has been initiated and the riser and upper safing package are physically and hydraulically disconnected from the lower safing package, the BOP stack, and the well.

Subsea well safing system 10 comprises safing package, or assembly, referred to herein as a catastrophic safing package ("CSP") 28 that is landed on BOP system 14 and operationally connects a riser 30 extending from platform 31 (e.g., vessel, rig, ship, etc.) to BOP stack 14 and thus well 18. CSP 28 comprises an upper CSP 32 and a lower CSP 34 that are adapted to separate from one another in response to initiation of a safing sequence thereby disconnecting riser 30 from the BOP stack 14 and well 18, for example as illustrated in FIG. 2. The safing sequence is initiated in response to parameters indicating the occurrence of a failure in well 18 with the potential of leading to a blowout of the well. According to one or more embodiments of the invention, subsea well safing system 10 may automatically initiate the safing sequence in response to the correspondence of monitored parameters to selected safing triggers. According to one or more embodiments of the invention CSP 28 may include an accumulator 29, see FIGS. 3 and 7, hydraulically connected to wellhead 16 to operate the wellhead connector lock as further described below. In the embodiment of depicted in FIG. 7, wellhead accumulator 29 is depicted as a standalone, accumulator located proximate to seafloor 20 and wellhead 16.

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

BOP stack 14 commonly includes a set of two or more BOPs 24 utilized to ensure pressure control of well 18. A typical stack might consist of one to six ram-type preventers and, optionally, one or two annular-type preventers. A typical stack configuration has the ram preventers on the bottom and the annular preventers at the top. The configuration of the stack preventers is optimized to provide maximum pressure integrity, safety and flexibility in the event of a well control incident. For example, one set of rams may be fitted to close on the drillpipe, blind rams to close on the open hole, and another set of shear rams to cut and hang-off the drillpipe. It is also common to have an annular preventer at the top of the stack to close over a wide range of tubular (e.g., drillpipe) sizes and the open hole. BOP stack 14 also includes various spools, adapters, and piping ports to permit circulation of wellbore fluids under pressure in the event of a well control incident.

LMRP 22 and BOP stack 14 are coupled together by a wellbore connector that is engaged with a corresponding mandrel on the upper end of BOP stack 24. LMRP 22 typically provides the interface (i.e., connection) of the BOPs 24 and the bottom end 30*a* of marine riser 30 via a riser connector 36 (i.e., riser adapter). Riser connector 36 commonly comprises a riser adapter for connecting the lowest end 30*a* of riser 30 (e.g., bolts, welding, hydraulic connector) and a flex joint that provides for a range of angular movement of riser 30 (e.g., 10 degrees) relative to BOP stack 14, for example to compensate for vessel 31 offset and current effects on along the length of riser 30. Riser connector 36 may further comprise one or more ports for connecting fluid (i.e., hydraulic) and electrical conductors, i.e., communication umbilical, which may extend along (exterior or interior) riser 30 from the drilling platform located at surface 5 to subsea drilling system 12. For example, it is common for a hydraulic choke line 44 and a hydraulic kill line 46 to extend from the surface for connection to BOP stack 14.

Riser 30 is a tubular string that extends from the drilling platform 31 down to well 18. The riser is in effect an extension of the wellbore extending through the water column to drilling vessel 31. The riser diameter is large enough to allow for drillpipe, casing strings, logging tools and the like to pass through. For example, in FIGS. 1 and 2, a tubular 38 (e.g., drillpipe) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 2 and may be utilized for various tasks.

Figure 3:
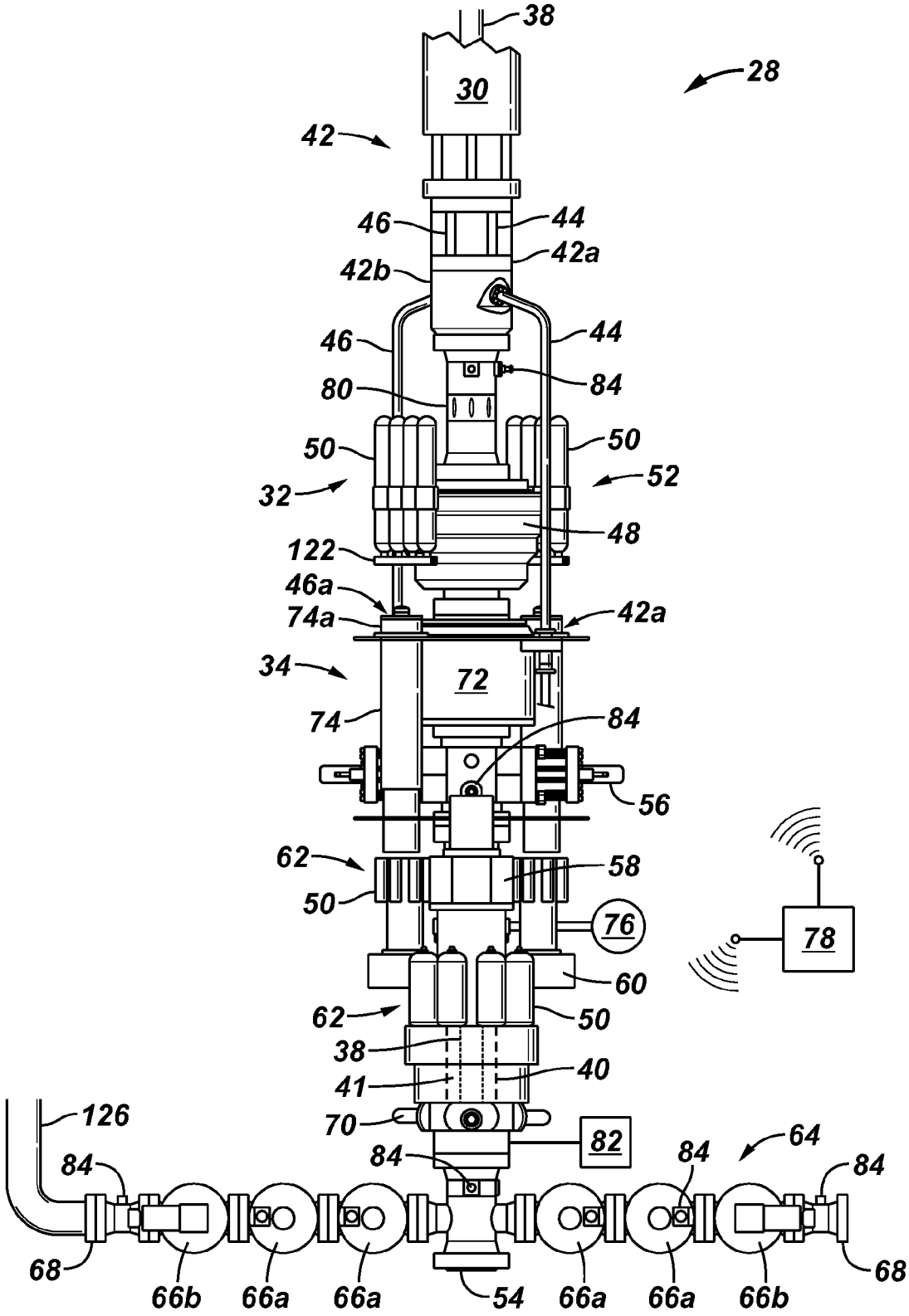
FIG. 3 illustrates a subsea well safing assembly according to one or more aspects of the invention in isolation.

Refer now to FIG. 3 which illustrates a subsea well safing package 28 according to one or more aspects of the invention in isolation. CSP 28 depicted in FIG. 3 is further described with reference to FIGS. 1 and 2. In the depicted embodiment, CSP 28 comprises upper CSP 32 and lower CSP 34. Upper CSP 32 comprises a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. CSP 28 comprises a choke stab 44*a* and a kill line stab 46*a* for interconnecting the upper portion of choke line 44 and kill line 46 with the lower portion of choke line 44 and kill line 46. As will be further described below with reference to safing sequence 86, stabs 44*a*, 46*a* also provide for disconnecting from the stab and kill lines during a safing operations; and during subsequent recovery and reentry operations reconnecting to the choke and kill lines via stabs 44*a*, 46*a*. In some embodiments, riser connector 42 may also comprise a flex joint.

CSP 28 comprises an internal longitudinal bore 40, depicted in FIG. 3 by the dashed line through lower CSP 34, for passing tubular 38. Annulus 41 is formed between the outside diameter of tubular 38 and the diameter of bore 40.

Upper CSP 32 further comprises a slips 48 (i.e., safety slips) adapted to close on tubular 38. Slips 48 are actuated in the depicted embodiment by hydraulic pressure from an accumulator 50. In the depicted embodiment, CSP 28 comprises a plurality of hydraulic accumulators 50 which may be interconnected in pods, such as upper accumulator pod 52. As will be understood by those skilled in the art with benefit of the present disclosure, accumulators 50 may be provided in various configurations. In the depicted embodiment, accumulators 50 are hydraulically charged and do not require connection to a hydraulic source at the surface. It will also be recognized by those skilled in the art that hydraulic pressure may be provided from the surface. In this embodiment, accumulators 50 located in the upper accumulator pod 52 are at least hydraulic connected to slips 48. In one or more embodiments of the invention, the pressure in accumulators 50 are monitored and accumulators 50 may be actuated in sequence and as needed to ensure that adequate hydraulic pressure is available and provided for actuation of CSP devices such as slips 48.

Lower CSP 34 comprises a connector 54 to connect to BOP stack 14, for example, via riser connector 36, rams 56 (e.g., blind rams), high energy shears 58, lower slips 60 (e.g., bi-directional slips), and a vent system 64 (e.g., valve manifold). Vent system 64 comprises one or more valves 66. In this embodiment, vent system 64 comprise vent valves (e.g., ball valves) 66*a*, choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well as further described below. Vent system 64 is further described below with reference to FIGS. 5 and 5A.

In the depicted embodiment, lower CSP 34 further comprises a deflector device 70 (e.g., impingement device, shutter ram) disposed above vent system 64 and below lower slips 60, shears 58, and blind rams 56. Lower CSP 34 includes a plurality of hydraulic accumulators 50 that are arranged and connected in one or more lower hydraulic pods 62 for operations of various devices of CSP 28. As will be further described below, CSP 28, in particular lower CSP 34, may include methanol, or other chemical, source 76 operationally connected for injecting into lower CSP 34, for example to prevent hydrate formation.

Upper CSP 32 and lower CSP 34 are detachably connected to one another by a connector 72. CSP connector 72 is depicted in the illustrated embodiments as a collet connector, comprising a first connector portion 72*a* and a second mandrel connector portion 72*b* which are illustrated for example in FIG. 13A. An ejector device 74 (e.g., ejector bollards) is operationally connected between upper CSP 32 and lower CSP 34 to separate upper CSP 32 and riser 30 from lower CSP 34 and BOP stack 14 after connector 72 has been actuated to the unlocked position. CSP 28 also includes a plurality of sensors 84 which can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example as further described below, forming a limit state sensor package.

According to one or more embodiments of the invention, CSP 28 comprises a control system 78 which may be located subsea, for example at CSP 28 or at a remote location such as at the surface. Control system 78 may comprise one or more controllers which are located at different locations. For example, in at least one embodiment, control system 78 comprise an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices and to surface (i.e., drilling platform 31) control systems.

With reference to the embodiments depicted in FIGS. 3 to 17, control system 78 includes upper controller 80 and a lower controller 82. Each of upper and lower controllers 80, 82 may comprise a collection of real-time computer circuitry, field programmable gate arrays (FPGA), I/O modules, power circuitry, power storage circuitry, software, and communications circuitry. One or both of upper and lower controller 80, 82 may comprise control valves.

According to at least one embodiment, one of the controllers, for example lower controller 82, serves as the primary controller and provides command and control sequencing to various subsystems of safing package 28 and/or communicates commands from a regulatory authority for example located at the surface. The primary controller, e.g., lower controller 82, contains communications functions, and health and status parameters (e.g., riser strain, riser pressure, riser temperature, wellhead pressure, wellhead temperature, etc.). One or more of the controllers may have black-box capability (e.g., a continuous-write storage device that does not require power for data recovery).

Upper controller 80 is described herein as operationally connected with a plurality of sensors 84 positioned throughout CSP 28 and may include sensors connected to other portions of the drilling system, including along riser 30, at wellhead 16, and in well 18. Upper controller 80, using data communicated from sensors 84, continuously monitors limit state conditions of drilling system 12. According to one or more embodiments, upper controller 80, may be programmed and reprogrammed to adapt to the personality of the well system based on data sensed during operations. If a defined limit state is exceeded an activation signal (e.g., alarm) can be transmitted to the surface and/or lower controller 82. A safing sequence may be initiated automatically by control system 78 and/or manually in response to the activation signal.

Figure 4A:
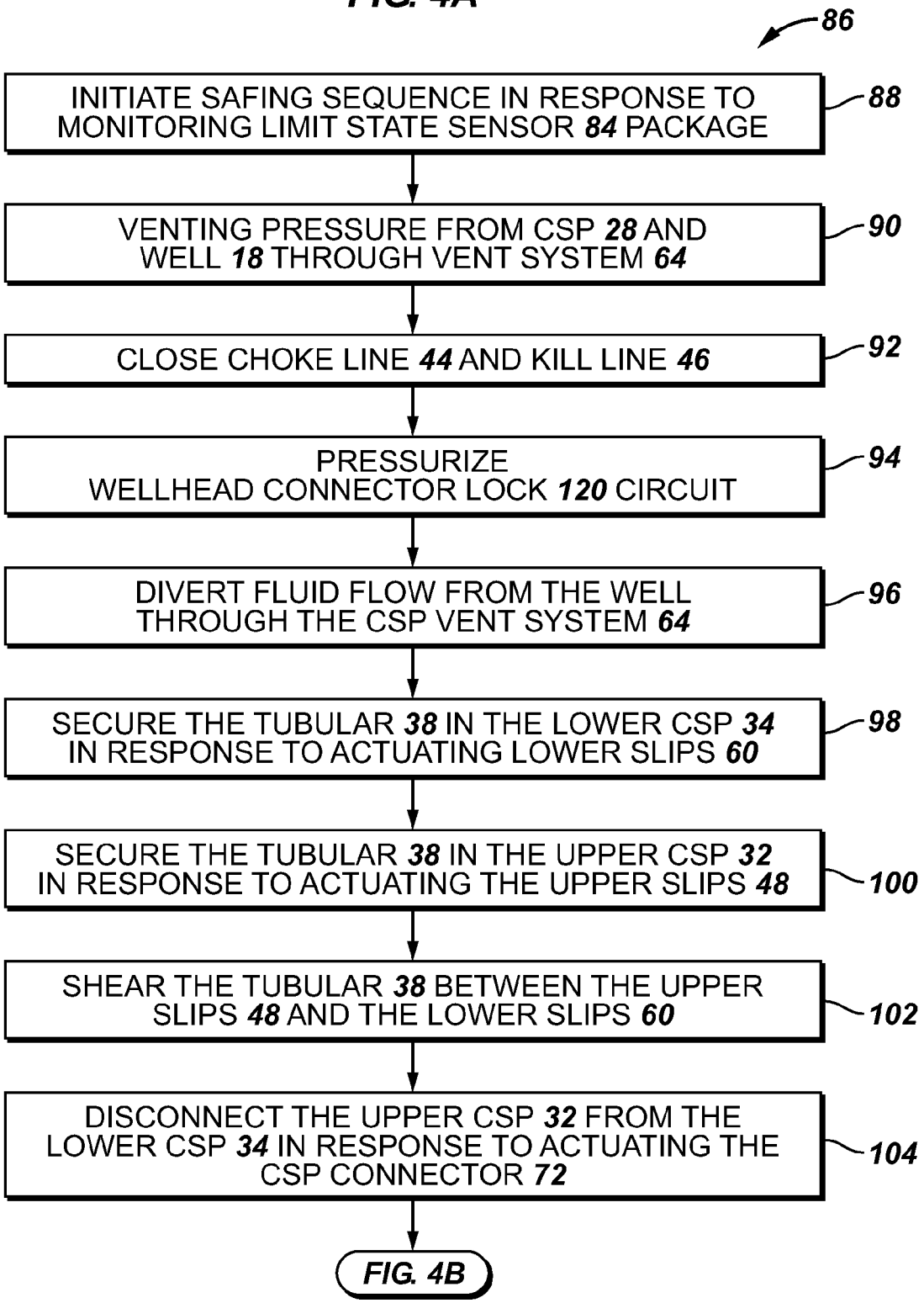
FIG. 4A-4B is a flow chart of a subsea well safing sequence according to one or more embodiments of the subsea well safing system.
Figure 4B:
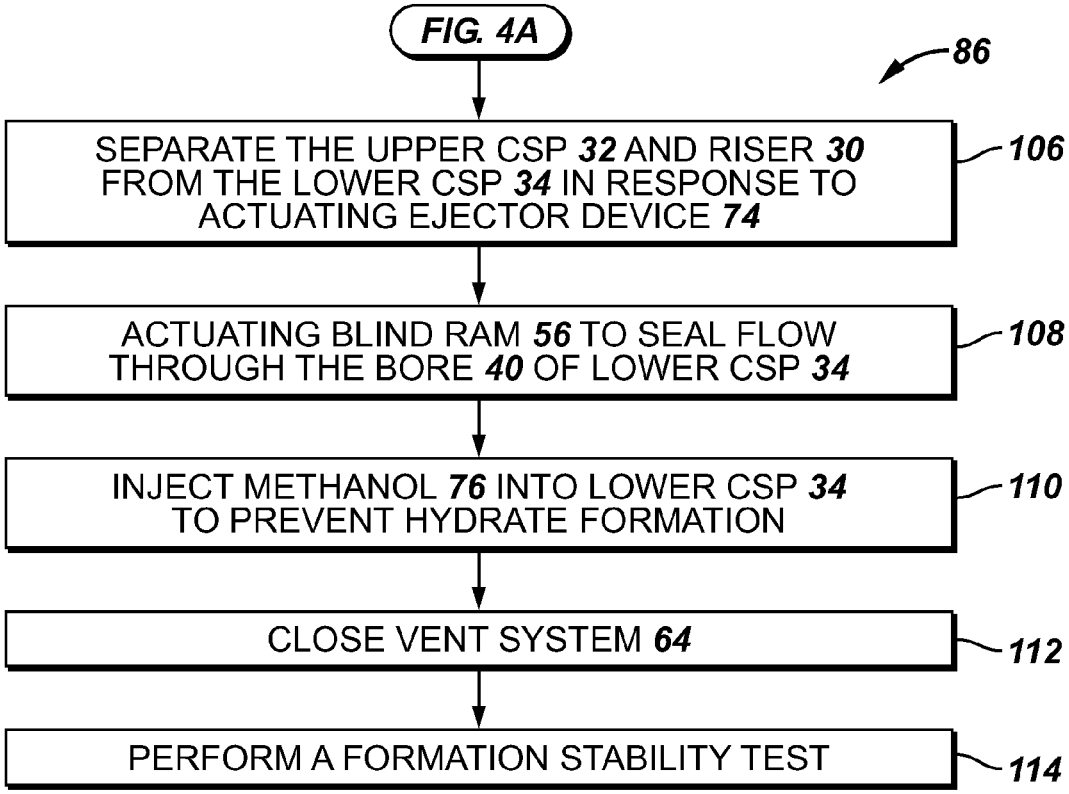

With reference to FIGS. 4A and 4B, a safing sequence 86 according to one or more embodiments of subsea well safing system 10 is disclosed. In sequence step 88, the safing sequence is initiated in response to monitoring the limit state sensor 84 package by upper controller 80. In sequence step 90, pressure is vented from CSP 28 by opening a valve 66*a* in vent system 64, see, e.g., FIGS. 1, 3, 5 and 5A. In sequence step 92, the choke and kill lines are closed to prevent combustibles from flowing up from the well and to the surface through the kill and choke lines, see, e.g., FIGS. 1, 3 and 6. In sequence step 94, the wellhead 16 connector lock is pressurized to prevent accidental ejection of BOP stack 14 from wellhead 16, see, e.g., FIGS. 3 and 7. In sequence step 96, fluid flowing up from the well is diverted, e.g., partially diverted, to the open vents to prevent erosion of CSP elements such as the slips 48, 60, see, e.g., FIGS. 1, 3, 8, 8A and 8B. For example, fluid flow may be diverted by operating a deflector device 70 to a closed position. In sequence step 98, tubular 38 is secured in lower CSP 34 by closing lower slips 60 (e.g., bi-directional slips), see, e.g., FIGS. 1, 3 and 9. In sequence step 100, tubular 38 is secured in upper CSP 32 by closing upper slips 48 (e.g., safety slips), see, e.g., FIGS. 1, 3 and 10. In sequence step 102, tubular 38 is sheared in lower CSP 34 by activating shears 58, see, e.g., FIGS. 1, 3 and 11. In sequence step 104, upper CSP 32 and lower CSP 34 are disconnected from one another by operating CSP connector 72 to a disconnected position, see, e.g., FIGS. 1, 3, 12 and 13A. In sequence step 106, riser 30 and upper CSP 32 are separated (e.g., ejected) from lower CSP 34 and BOP stack 14 by activating ejector device 74 (i.e., ejector bollards), see, e.g., FIGS. 1-3, 13, and 13A. In sequence step 108, (see, e.g., FIGS. 1-3 and 14) blind rams 56 are closed to shut-off fluid flow from BOP stack 14 through bore 40 (see FIG. 3) and escaping to the environment. In sequence step 110, treating hydrate formation in lower CSP 34 by injecting methanol, see, e.g., FIGS. 1-3 and 15. In sequence step 112, closing the vents 66*a* opened in vent system 64 in sequence step 90, see, e.g., FIGS. 1-3 and 16. In sequence step 114, performing a formation stability test, see, e.g., FIGS. 1-3 and 17.

Figure 5:
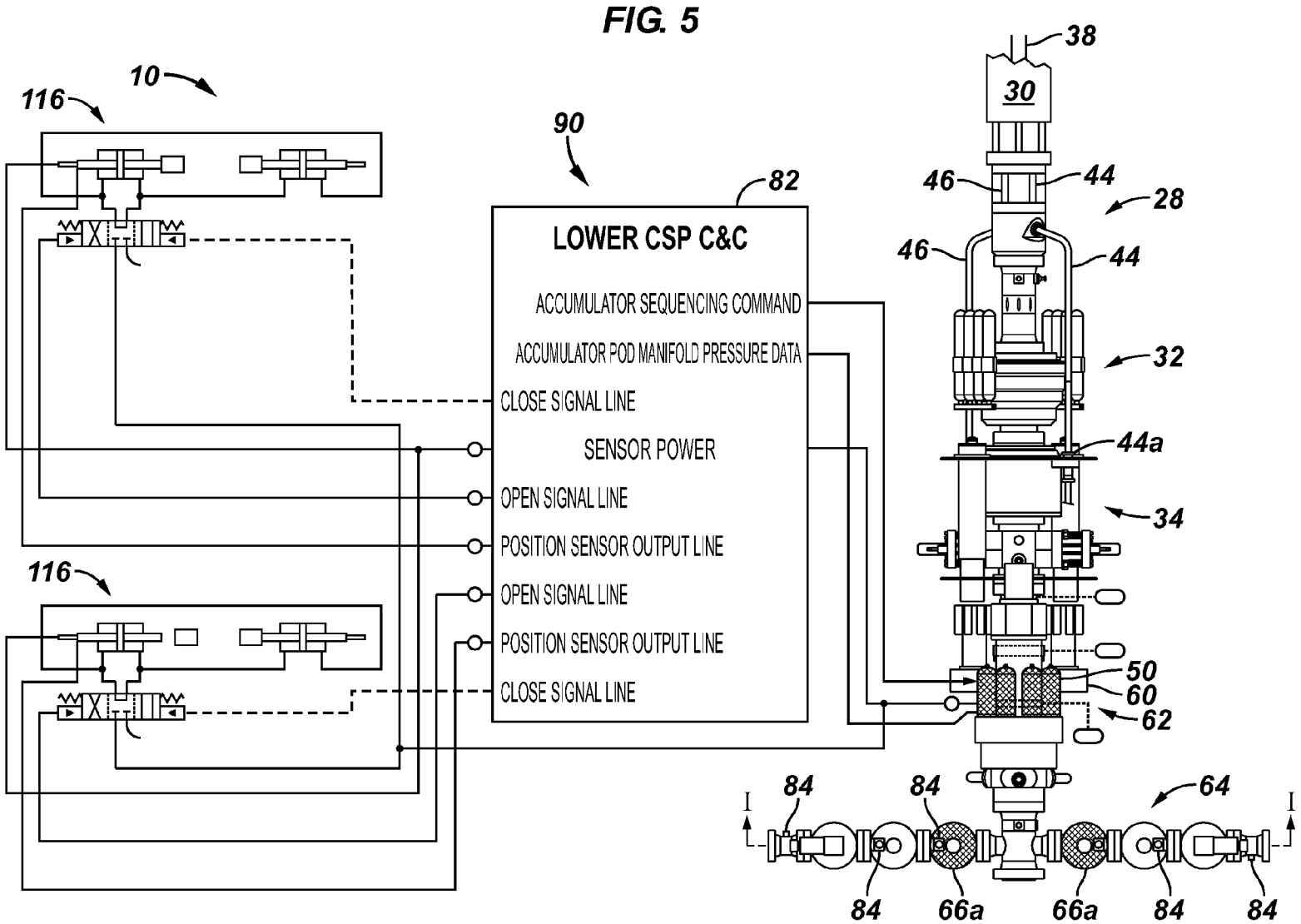

FIG. 5 is a schematic diagram of sequence step 90, according to one or more embodiments of subsea well safing system 10 which is described with further reference to FIGS. 1 and 3. In response to initiating safing sequence 86, one or more vent valves 66*a* of vent system 64 are opened. Valves 66*a* are opened to reduce the flow of fluid through the annulus 41 between tubular 38 and the CSP 28 walls forming bore 40 through CSP 28 (see FIG. 3, the dashed lines in lower CSP 34) and lowering the backpressure on lower slips 60. The open and closed position of vent valves 66*a* can be verified by a control signal from each valve position sensor 84. An accumulator 50 located in the assigned accumulator pod 62 is activated to provide hydraulic power to the valve actuators 116 of controller 82. Lower controller 82 continuously monitors the accumulator pod 62 pressure and activates additional accumulators 50 as may be required to maintain working pressure. With reference to FIGS. 5-17, the active device (e.g., accumulators, valves, slips, shears) of the depicted sequence step are emphasized by hatching.

Figure 5A:
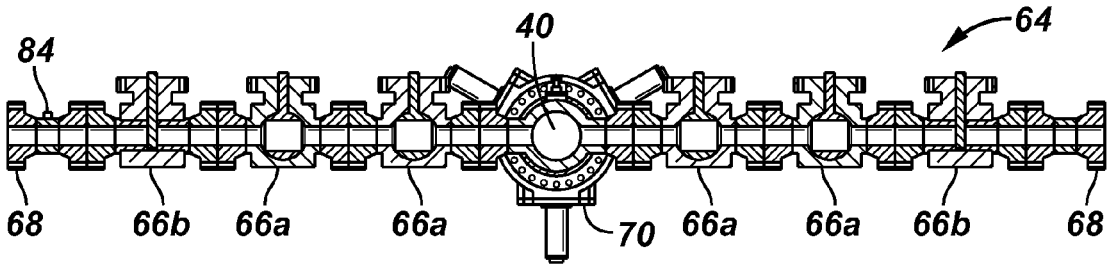
FIG. 5A is a sectional view of a vent system according to one or more embodiments of the well safing package shown along the line I-I of FIG. 5.

FIG. 5A is a sectional view of an embodiment of vent system 64 shown along the line I-I of FIG. 5. FIG. 5A depicts two vent valves 66*a* on each side of vent system 64, which are depicted in the closed position. Valves 66*b* are positioned to control flow through connection mandrels 68. In the depicted embodiment, the sensor 84 located proximate to the connection mandrel 84 is an accelerometer.

Figure 6:
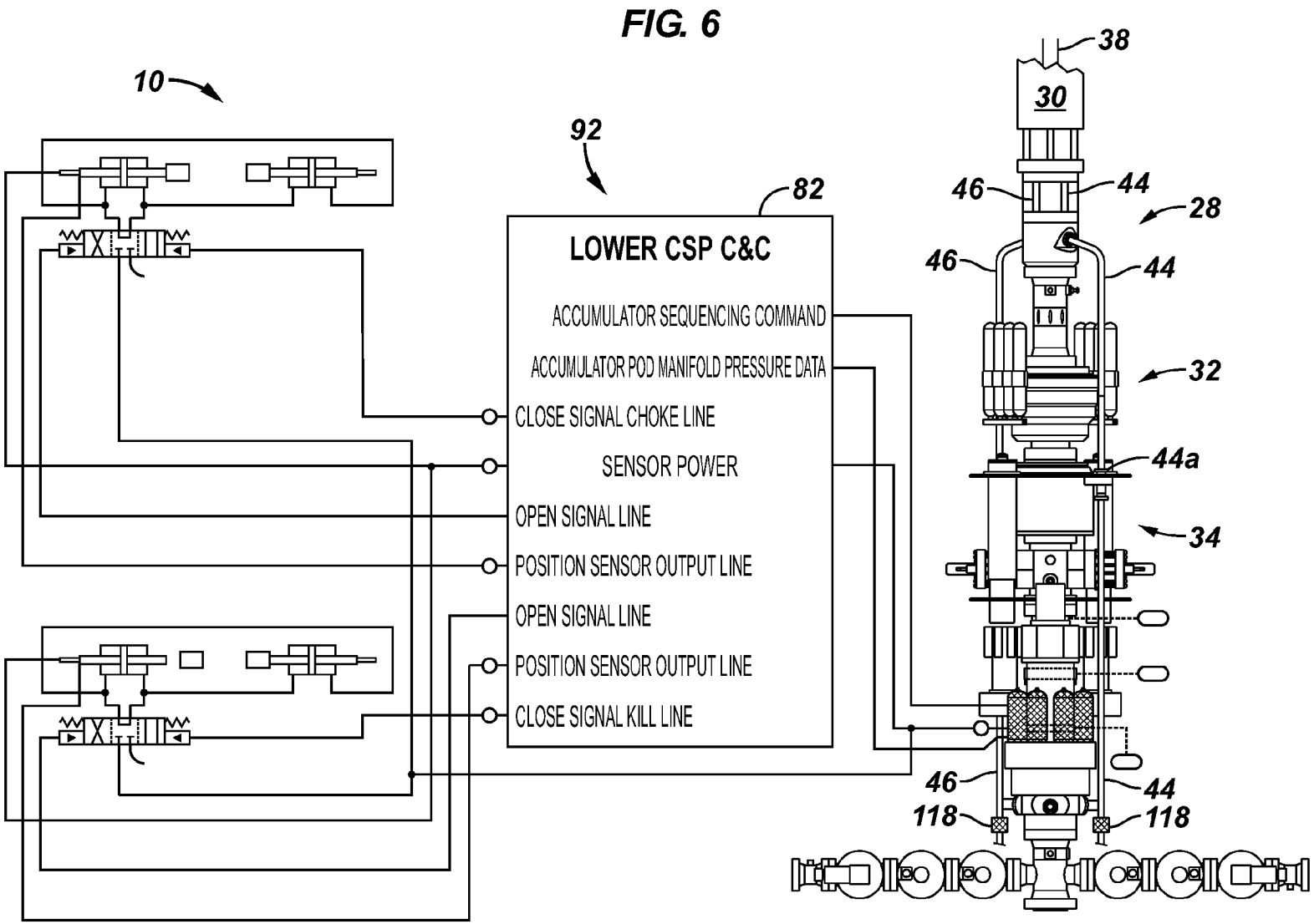

FIG. 6 is a schematic diagram of sequence step 92, according to one or more embodiments of subsea well safing system 10 which is described with further reference to FIGS. 1 and 3. In sequence step 92, valves 118 positioned in each of choke line 44 and kill line 46 are actuated from the open to the closed position to prevent combustibles from flowing up the choke line 44 and the kill line 46.

Figure 7:
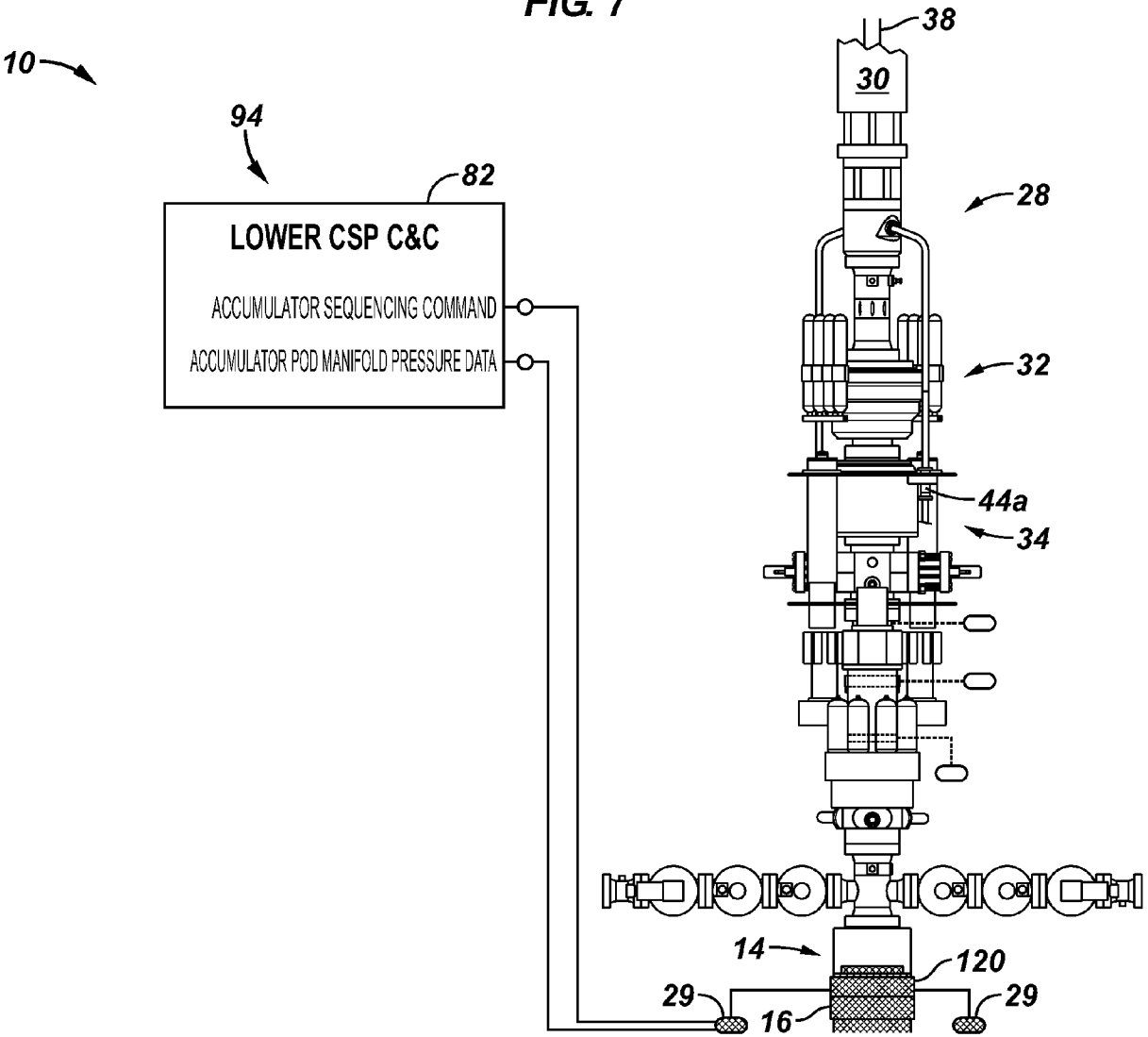

FIG. 7 is a schematic diagram of sequence step 94, according to one or more embodiments of subsea well safing system 10 which is described with further reference to FIGS. 1 and 3. Controller 82 initiates the pressurization of wellhead connector lock 120 to prevent the accidental ejection of BOP stack 14 from wellhead 16 due to the high back pressure encountered in subsequent sequence steps, e.g., when deflector device 70 is closed, slips 48, 60 are closed; and due to the loss of hydraulic pressure to wellhead connector lock 120 when riser 30 is disconnected from BOP stack 14 disconnecting any hydraulic sources extending along riser 30 to CSP 28.

Figure 8A:
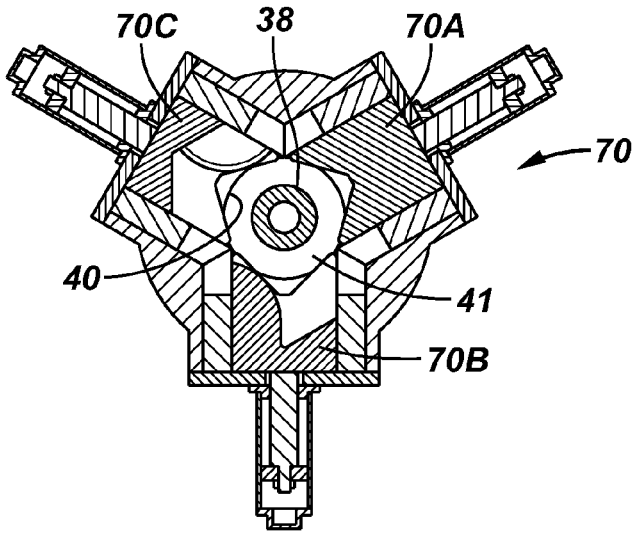
FIG. 8A is a sectional view of an embodiment of a deflector device shown along the line I-I of FIG. 8.
Figure 8B:
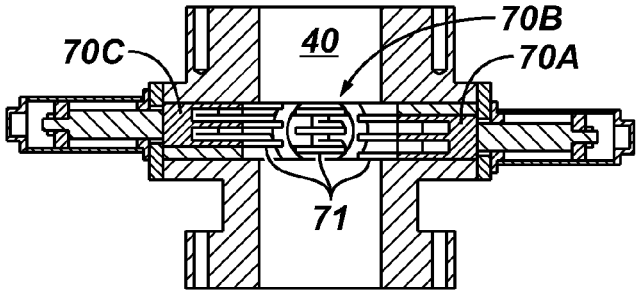
FIG. 8B is a sectional, side view of an embodiment of the impingement device of FIG. 8A in isolation.
Figure 8:
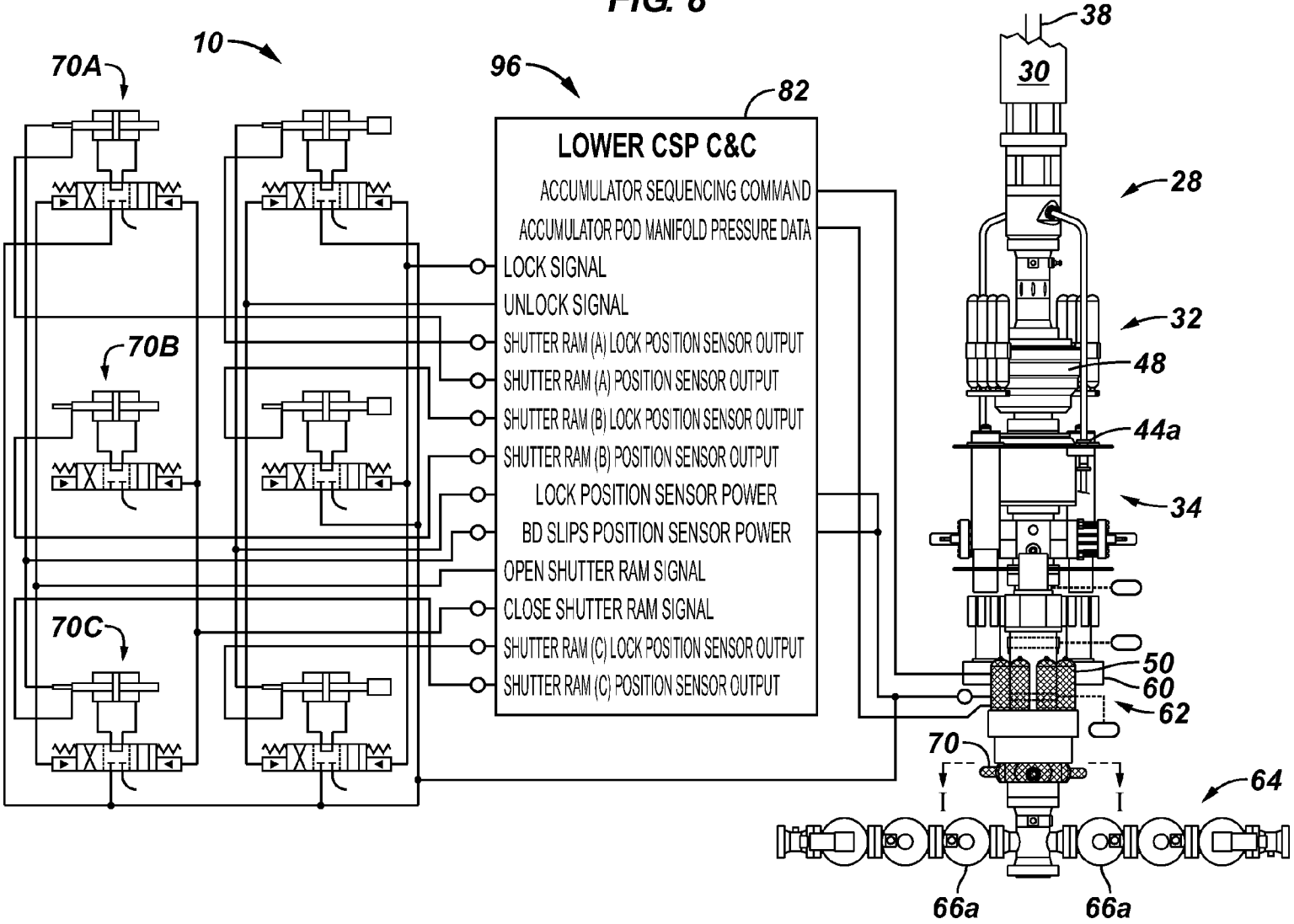

FIG. 8 is a schematic diagram of sequence step 96, according to one or more embodiments of subsea well safing system 10 which is described with further reference to FIGS. 1, 3, 8A and 8B. In sequence step 96, controller 82 actuates deflector device 70, described in the embodiments of FIG. 8, 8A and 8B as shutter ram 70, to a closed position (see FIG. 8A) in response to applying hydraulic pressure in the embodiment of FIG. 8 from a hydraulic accumulator 50 of lower accumulator pod 62. In the closed position, deflector device 70 diverts fluid flow from passing through annulus 41 of CSP 28 to vent system 64 and open vent valves 66*a*. The closed shutter ram 70, depicted in FIG. 8A, protects CSP 28 from the high flow rates and entrained solids that are encountered thereby limiting erosion of devices of CSP 28, such as upper safety slips 48 and lower slips 60. Shutter ram 70 may be provided in various manners and configurations. Referring to FIG. 8A, tubular 38 is depicted substantially centered within bore 40 of shutter ram 70 which is coaxial with bore 40 of CSP 28 by rams 70A, 70B, and 70C. According to at least one embodiment, closure of rams 70A, 70B, 70C does not seal annulus 41. In the embodiment as depicted in FIG. 8B, each of rams 70A, 70B and 70C comprises stacked and spaced apart plates 71 which interleave portions of the plates 71 of the adjacent rams.

Figure 9:
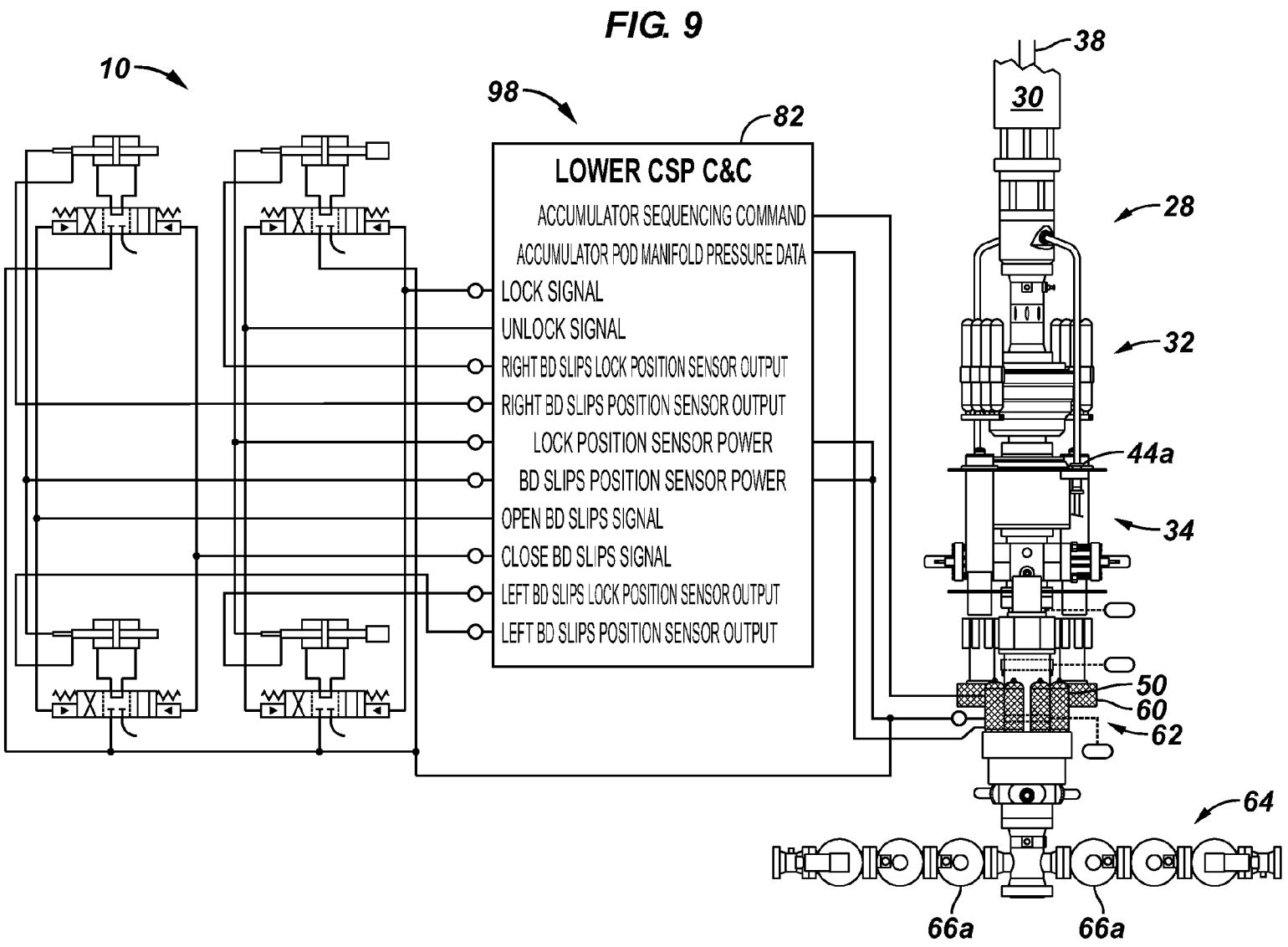

FIG. 9 is a schematic diagram of sequence step 98, according to one or more embodiments of subsea well safing system 10 which is described with further reference to FIGS. 1 and 3. In sequence step 98, controller 82 actuates lower slips 60 (e.g., bi-directional slips) securing tubular 38 within lower CSP 34 in preparation for sequence step 102. In some embodiments, lower slips 60 may comprise deflector armor to divert fluid flow toward vent system 64 instead of, or in addition to, shutter ram 70 described and disclosed with reference to sequence step 96 and FIGS. 8, 8A, and 8B.

FIG. 10 is a schematic diagram of sequence step 100, according to one or more embodiments of subsea well safing system 10 which is described with further reference to FIGS. 1 and 3. In sequence step 100, upper slips 48 are actuated to engage tubular 38 within upper CSP 32. In this embodiment, sequence step 100 is actuated by upper controller 80. As with other sequence steps, the controller monitors the pressure status of accumulators 50 and if a low pressure is detected, a subsequent accumulator in a pod is activated to actuate the sequence step device (i.e., slips 48 in sequence step 100).

Figure 11:
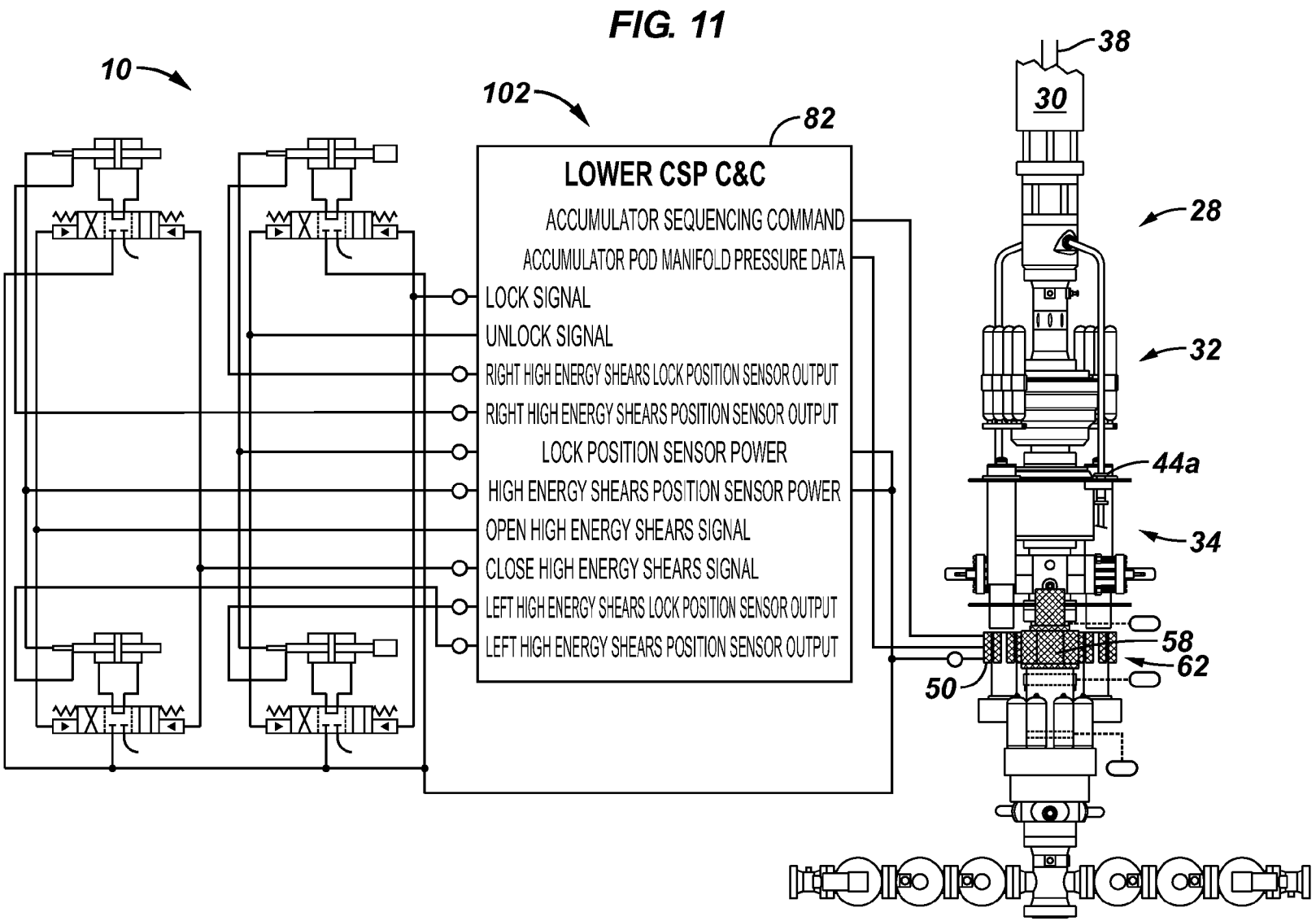

FIG. 11 is a schematic diagram of sequence step 102, according to one or more embodiments of subsea well safing system 10 which is described with further reference to FIGS. 1 and 3. After tubular 38 is engaged and secured respectively in upper CSP 32 (i.e., by slips 48) and lower CSP 34 (i.e., slips 60), lower controller 82 actuates shears 58 thereby shearing tubular 38 between upper slips 48 and lower slips 60.

Figure 12:
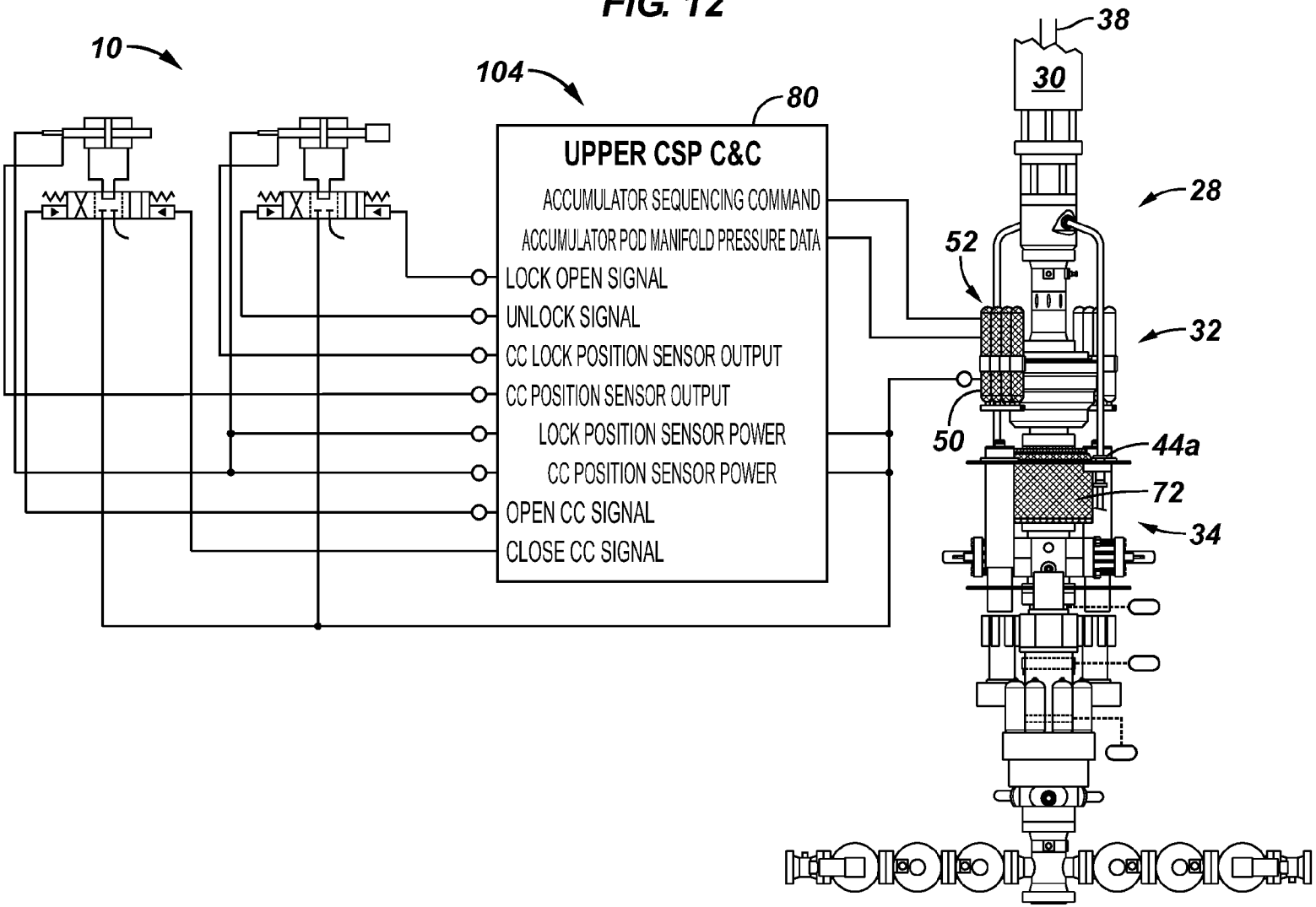

FIG. 12 is a schematic diagram of sequence step 104, according to one or more embodiments of subsea well safing system 10 which is described with further reference to FIGS.

1, 2, 3 and 13A. In sequence step 104, CSP connector 72 is actuated to the open, or disconnected, position permitting separation of upper CSP 32 from lower CSP 34 in sequence step 106. In this embodiment, CSP connector 72 is actuated via upper controller 80 and hydraulic accumulators 50 located in upper accumulator pod 52. In the depicted embodiment, CSP connector 72 is a collet comprising a first connector portion 72*a* and a second connector portion 72*b*, depicted for example in FIG. 13A. Second connector portion 72*b* is disposed with lower CSP 34 and comprises a mandrel, identified individually by the numeral 72*c* (see, FIGS. 13A, 14-17). The mandrel 72*c* provides a mechanism for reconnecting, for example with a riser, for re-entry into well 18.

Figure 13:
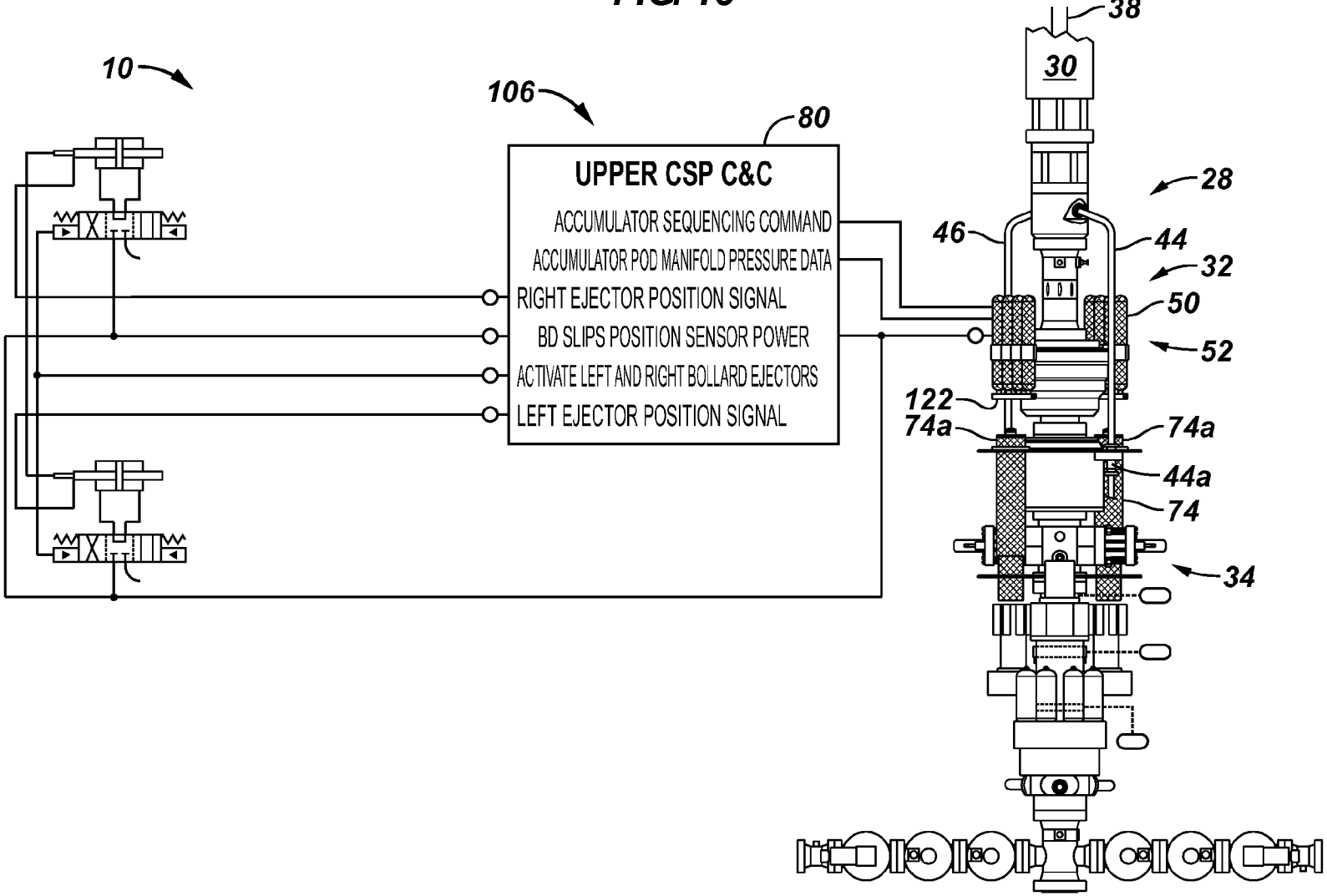
Figure 13A:
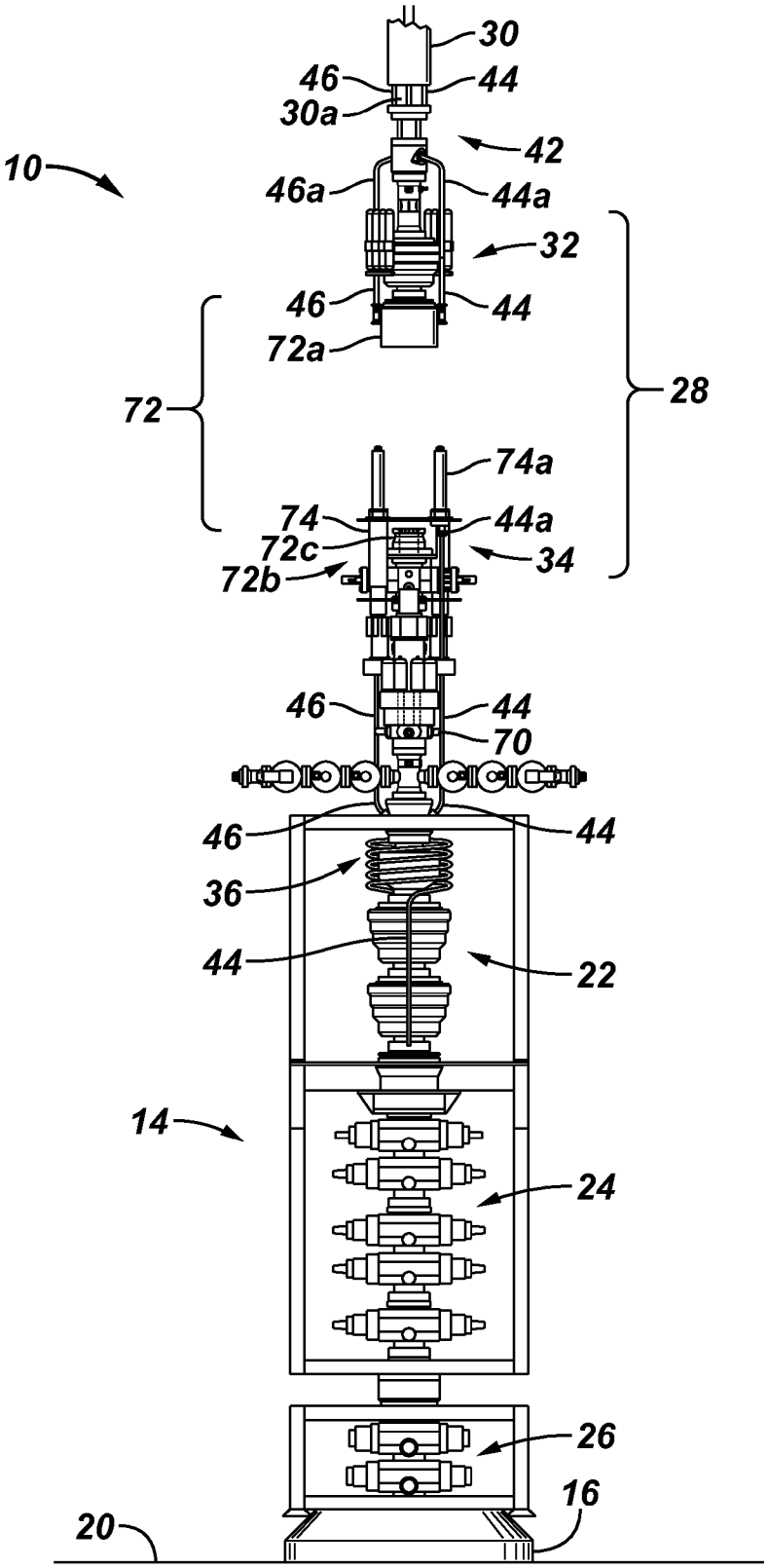
FIG. 13A illustrates the riser and upper safing package disconnected and separated from the lower safing package and the wellhead in response to progression of the subsea well safing sequence.

FIG. 13 is a schematic diagram of sequence step 106, according to one or more embodiments of subsea well safing system 10 which is described with further reference to FIGS. 1-3 and 13A. In sequence step 106, ejector devices 74 (i.e., ejector bollards) are actuated to physically separate upper CSP 32 and riser 30 from lower CSP 34 as depicted in FIGS. 2 and 13A. For example, ejector devices 74 may include piston rods 74*a* which extend to push the upper CSP 32 away from lower CSP 34 in the depicted embodiment. FIGS. 2, 13A, and 14-17 illustrate piston rod 74*a* in an extended position. In the embodiment of FIG. 13, actuation of ejector devices 74 is provided by upper controller 80 and accumulator(s) 50 located in upper accumulator pod 52.

Typically, riser 30 will be in tension which will assist in pulling the disconnected upper CSP 32 vertically away from lower CSP 34. In addition, the water currents and deflection in riser 30 (e.g., offset from platform 31) will assist in moving riser 30 and separated upper CSP 32 laterally away from lower CSP 34 and the well. Choke line 44 and kill line 46 are disconnected respectively at choke stab 44*a* and kill stab 46*a* (FIG. 3). Stabs 44*a* and 46*b* provide a means for reconnection to surface sources during recovery operations.

In the depicted embodiments, ejector device 74 is attached to lower CSP 34 and piston rods 74*a* push against a portion of upper CSP 32, for example a portion of the frame 122 of upper CSP 32 shown generally in FIG. 13. It will be understood by those skilled in the art with benefit of this disclosure that ejector device 74 may be arranged in different configurations without departing from the scope of the invention. For example, ejector device 74 may be reversed so as to be attached with upper CSP 32 wherein piston rod 74*a* acts against lower CSP 34.

Figure 14:
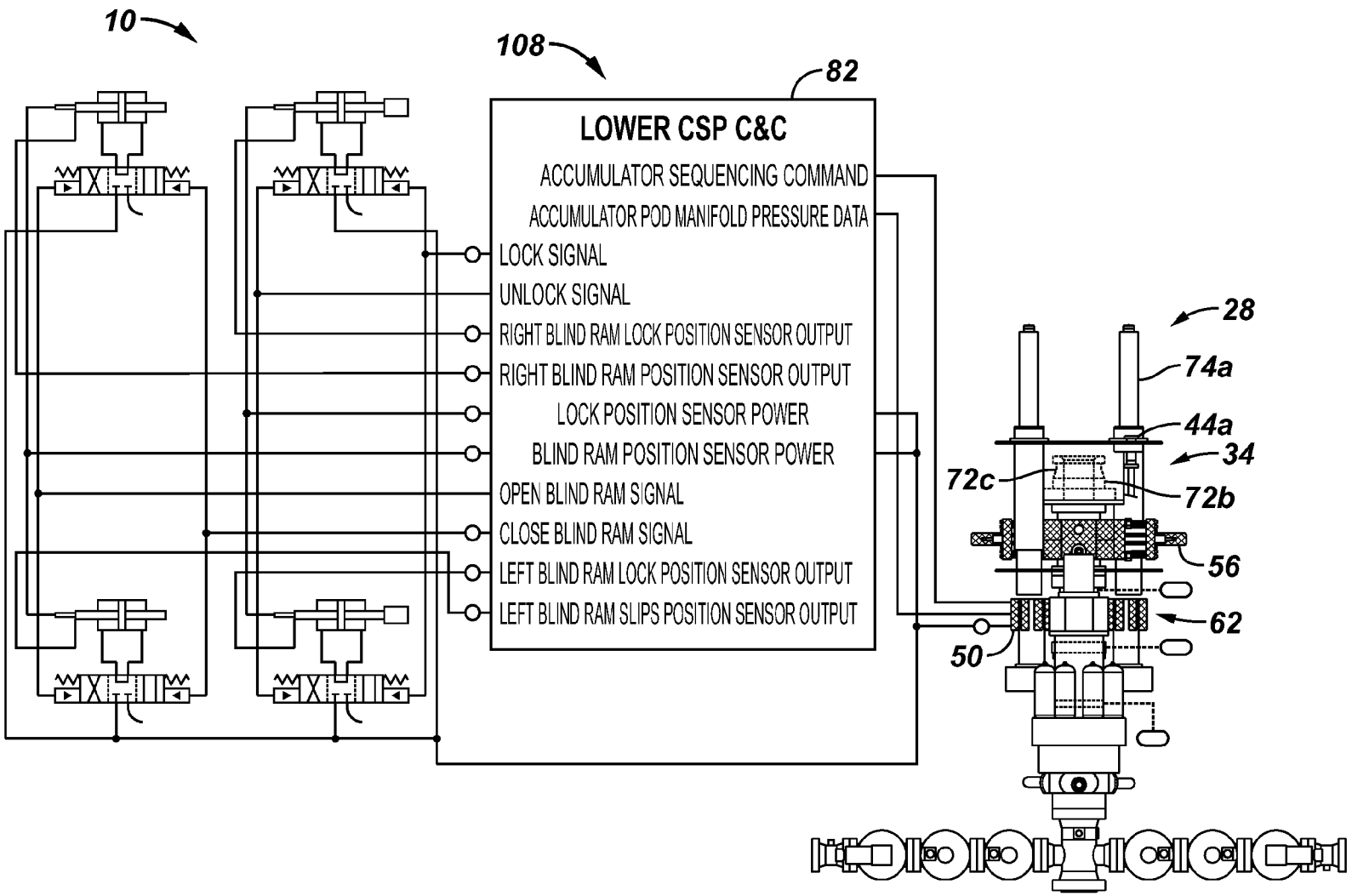

FIG. 14 is a schematic diagram of sequence step 108, according to one or more embodiments of subsea well safing system 10 which is described with further reference to FIGS. 1, 2 and 3. In sequence step 108, blind rams 56 are actuated to the closed position sealing bore 40 (see FIGS. 3 and 8A, 8B) to block any fluid that may be flowing up from well 18 through BOP stack 14. In the depicted embodiment, actuation of blind rams 56 is provided by lower controller 82 and accumulator(s) 50 located in lower accumulator pod(s) 62.

Figure 15:
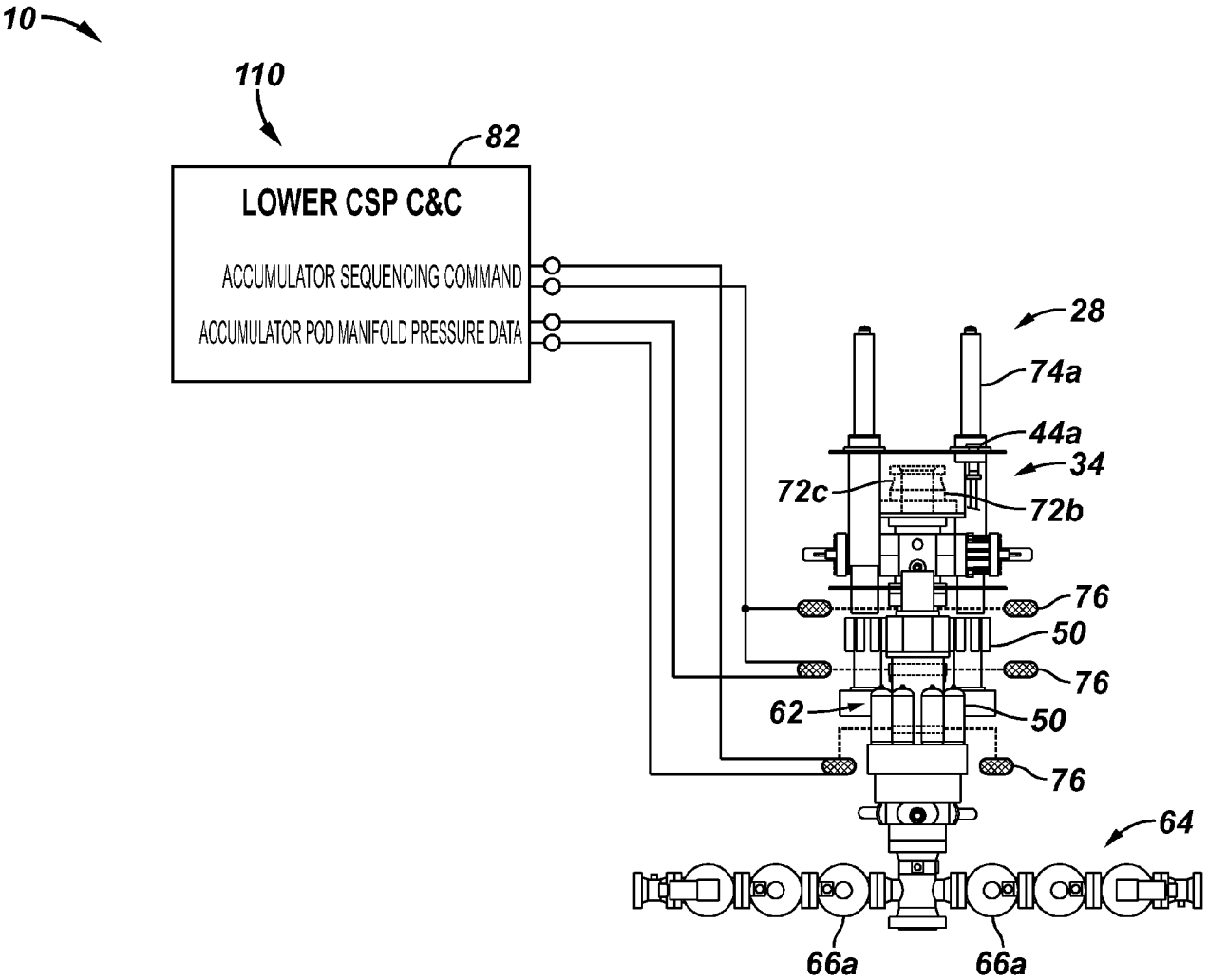

FIG. 15 is a schematic diagram of sequence step 110, according to one or more embodiments of subsea well safing system 10 which is described with further reference to FIGS. 1, 2 and 3. In sequence step 110, methanol 76 may be injected into lower CSP 34 to prevent hydrate formation CSP 28, in particular in the vents (e.g., vent valves 66*a*) of vent system 64. In the depicted embodiment, the injection of methanol 76 is provided by lower controller 82 and may be powered by accumulator(s) 50 located in lower accumulator pod(s) 62.

Figure 16:
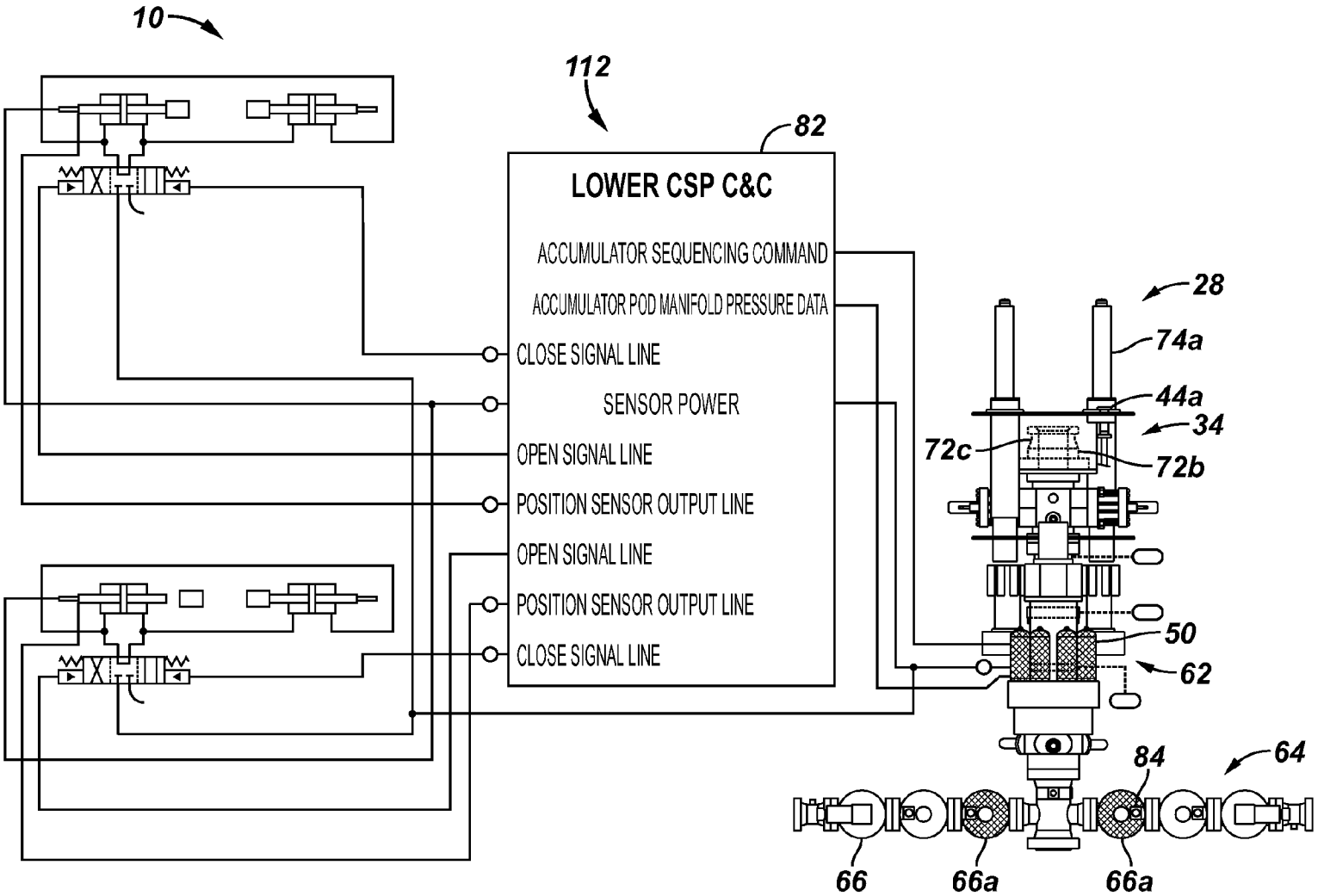

FIG. 16 is a schematic diagram of sequence step 112, according to one or more embodiments of subsea well safing system 10 which is described with further reference to FIGS. 1, 2 and 3. In sequence step 112, lower controller 82 actuates hydraulic power (e.g., accumulator 50) to actuate the open vent valves 66*a* from the open to the closed position.

Figure 17:
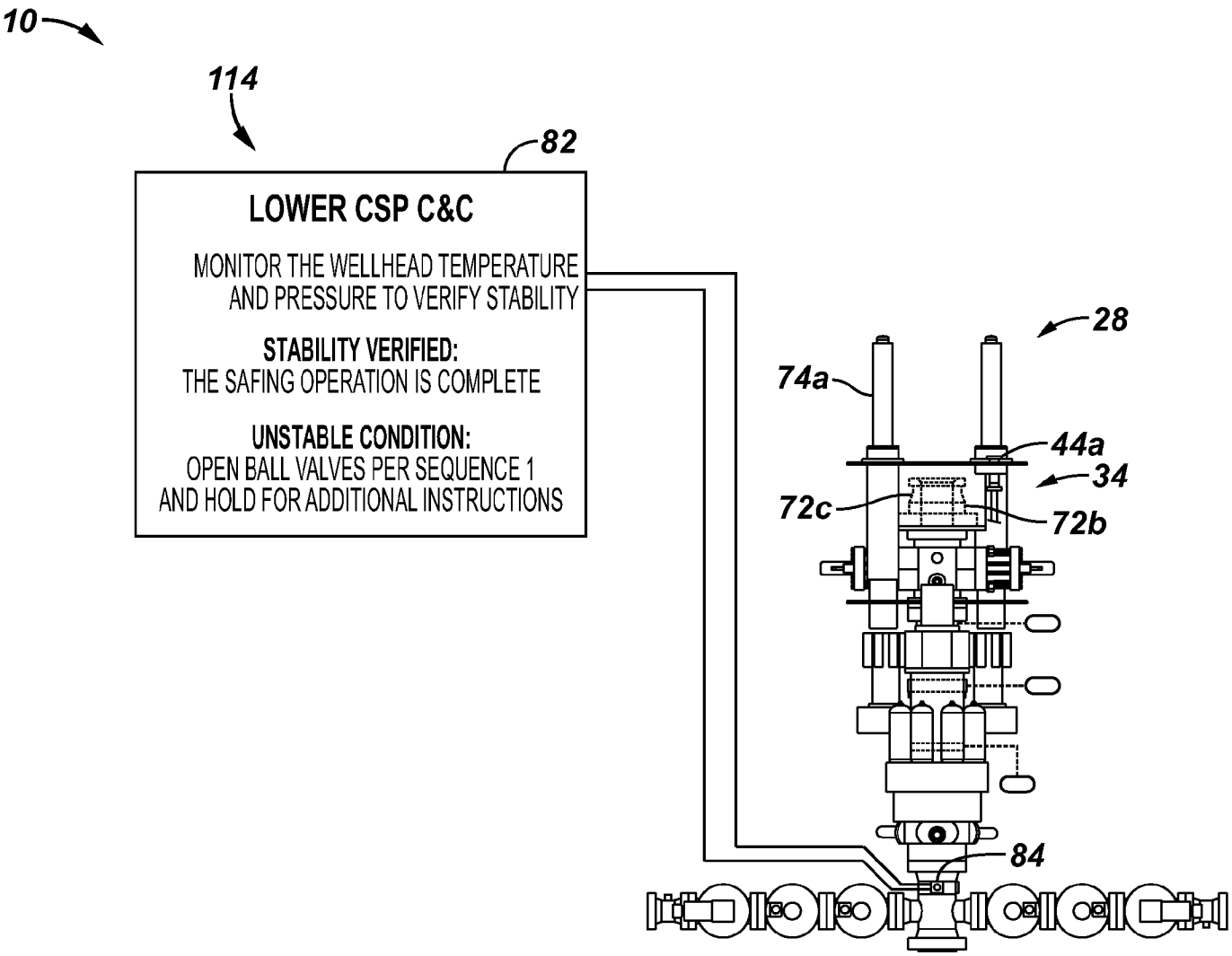

FIG. 17 is a schematic diagram of sequence step 114, according to one or more embodiments of subsea well safing system 10 which is described with further reference to FIGS. 1-3. Subsequent to closing vent valves 66*a* in sequence step 112, lower controller 82 can initiate and perform a formation stability test for example by monitoring wellhead temperature and pressure via one or more sensors 84.

If stable formation conditions are indicated, safing system 10 may be placed in a standby condition until recovery operations can be initiated and completed. If unstable formation conditions are indicated, vent valves 66*a* may be opened to relieve pressure in an effort to prevent a subsurface blowout of well 18, which will result in loss of the well and require more difficult and time consuming processes to plug well 18. With effluent venting to the environment, a recovery riser 126 extending, for example from a vessel at surface 5, may be connected to connection mandrel 68 of vent system 64 as depicted in FIG. 3. ROV 124 (FIG. 2) may be utilized to connect flexible riser 126. A valve, such as valve 68*b*, may be operated to the open position permitting flow of effluent through mandrel 68 of vent system 64 into riser 126 and to the surface; and the open vent valves 66*a* are operated to the closed position, thus providing a means to limit environmental damage until control of well 18 can be recovered.

According to one embodiment, a method of recovery of well 18 comprises closing in well 18 via lower CSP 34 and/or venting effluent from well 18 through vent system 64 and a recovery riser 126 to the surface. A riser 30 and choke line 44 and/or kill line 46 hydraulics are extended from the surface to lower CSP 34. Choke and kill lines 44, 46 can be connected to BOP stack 14 and well 18 via choke stab 44*a* and kill stab 46*a* which are located on lower CSP 34 which is still connected to well 18. Riser 30 in some circumstances may be connected to connector mandrel 72*b* of CSP connector 72 to reestablish hydraulic communication with well 18 through BOP stack 14. Depending on the status of BOP stack 14 and formation stability, drilling mud may be circulated down one of riser 30, kill line 46, choke line 44, and/or flexible riser 126 to kill well 18.

According to one or more aspects of the invention, a subsea well safing package for installing on a blowout preventer stack on a subsea well comprises a safing assembly connector interconnecting a lower safing assembly and an upper safing assembly, the safing assembly connector operable to a disconnected position, wherein the lower safing assembly is adapted to be connected to a blowout preventer stack on a subsea well and the upper safing assembly is adapted to be connected to a marine riser; the lower assembly comprising lower slips to engage a tubular suspended in a bore formed through the lower and the upper safing assemblies; the upper safing assembly comprising upper slips operable to engage the tubular; and a shear positioned between the upper slips and the lower slips, the shear operable to shear the tubular.

According to one or more aspects of the invention a subsea well safing package is provided for installing on a blowout preventer stack on a subsea well comprises a safing assembly connector interconnecting a lower safing assembly and an upper safing assembly, the safing assembly connector operable to a disconnected position, wherein the lower safing assembly is adapted to be connected to a blowout preventer stack on a subsea well and the upper safing assembly is adapted to be connected to a marine riser; the lower assembly comprising lower slips to engage a tubular suspended in a bore formed through the lower and the upper safing assemblies; the upper safing assembly comprising upper slips operable to engage the tubular; a shear positioned between the upper slips and the lower slips, the shear operable to shear the tubular; and an ejector device connected between lower safing assembly and the upper safing assembly, the ejector device operable to physically separate the upper safing assembly from the lower safing assembly.

The package may include a vent carried by the lower safing assembly, the vent operable between an open and a closed position. In at least one embodiment the package further includes a vent carried by the lower safing assembly and positioned below the lower slip when connected to the well, wherein the vent is operable between an open and a closed position.

According to one or more embodiments of the invention, the ejector device includes an extendable piston rod. The piston rod may be extendable in response to the application of hydraulic pressure.

According to one or more embodiments of the invention, the safing package comprises a hydraulic accumulator disposed with the safing assembly and in hydraulic communication with the lower slips. In some embodiments, a plurality of hydraulic accumulators are arranged in an upper accumulator pod, wherein the upper accumulator pod is in hydraulic communication with the upper slips. According to at least one embodiment the shear is in hydraulic communication with at least one of a lower hydraulic accumulator pod and an upper hydraulic accumulator pod. Similarly, the ejector device is in hydraulic communication with at least one of a lower hydraulic accumulator pod and an upper hydraulic accumulator pod in some embodiments.

According to one or more embodiments, a vent is carried by the lower safing assembly and positioned below the lower slip when connected to the well, wherein the vent is operable between an open and a closed position; and a deflector device is positioned between the lower slips and the vent, wherein the deflector device is operable to a closed position to divert fluid flow toward the vent. In some embodiments, the deflector device does not seal against the tubular suspended in the lower safing assembly when in the closed position.

A subsea well safing system according to one or more aspects of the invention comprises a safing assembly comprising a lower safing assembly connected to a blowout preventer stack connected to a subsea well and an upper safing assembly connected to a marine riser; a safing assembly connector interconnecting the lower safing assembly and the upper safing assembly providing a bore therethrough in communication with the marine riser and the well; and an ejector device connected between the upper safing assembly and the lower safing assembly, the ejector device operable to physically separate the upper assembly and connected marine riser from the lower safing assembly.

The safing assembly can further comprise, for example, lower slips operable to engage a tubular suspended in the bore of the lower safing assembly; upper slips operable to engage the tubular suspend in the bore of the upper safing assembly; a shear located between the lower slips and the upper slips operable to shear the tubular; and a vent in communication with the bore, the vent operable between a closed position and an open position. In some embodiments, the safing system further comprises a deflector device located in the lower safing assembly between the lower slips and the vent, the deflector device operable to a closed position to divert fluid flow toward the vent.

According to one or more aspects of the invention, a subsea well safing sequence comprises utilizing a safing assembly installed between a blowout preventer stack of a subsea well and a marine riser, the safing assembly comprising a lower safing assembly connected to the blowout preventer stack and an upper safing assembly connected to the marine riser forming a bore between the riser and the blowout preventer stack; securing a tubular suspended in the bore at a position in the lower safing assembly; securing the tubular at a position in the upper safing assembly; shearing the tubular in the bore between the position in the lower safing assembly and the position in the upper safing assembly at which the tubular has been secured; and physically separating the upper safing assembly and the connected marine riser from the lower safing assembly connected to the blowout preventer stack.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A subsea well safing package for installing on a blowout preventer stack on a subsea well, the package comprising:

a safing assembly connector interconnecting a lower safing assembly and an upper safing assembly, the safing assembly connector operable to a disconnected position, wherein the lower safing assembly is to be connected to a blowout preventer stack on a subsea well and the upper safing assembly is to be connected to a marine riser;

the lower safing assembly comprising lower slips to engage and secure a tubular suspended in a bore formed through the lower and the upper safing assemblies;

the upper safing assembly comprising upper slips operable to engage and secure the tubular; and a shear positioned between the upper slips and the lower slips, the shear operable to shear the tubular.

2. The package of claim 1, further comprising a vent carried by the lower safing assembly, the vent operable between an open and a closed position.

3. The package of claim 1, further comprising a vent carried by the lower safing assembly and positioned below the lower slips when connected to the well, wherein the vent is operable between an open and a closed position.

4. The package of claim 1, further comprising an ejector device connected between the lower safing assembly and the upper safing assembly, the ejector device operable to push the upper safing assembly and the lower safing assembly apart and thereby physically separate the upper safing assembly from the lower safing assembly.

5. The package of claim 4, wherein the ejector device comprises a piston rod operable to an extended position in response to the application of hydraulic pressure.

6. The package of claim 1, further comprising a hydraulic accumulator in hydraulic communication with one selected from the lower slips and the upper slips.

7. The package of claim 1, further comprising:

a plurality of hydraulic accumulators arranged in a lower accumulator pod, wherein the lower accumulator pod is in hydraulic communication with the lower slips; and a plurality of hydraulic accumulators arranged in an upper accumulator pod, wherein the upper accumulator pod is in hydraulic communication with the upper slips.

8. The package of claim 4, further comprising:

a plurality of hydraulic accumulators arranged in a lower accumulator pod, wherein the lower accumulator pod is in hydraulic communication with the lower slips;

a plurality of hydraulic accumulators arranged in an upper accumulator pod, wherein the upper accumulator pod is in hydraulic communication with the upper slips;

the shear in hydraulic communication with at least one of the lower accumulator pod and the upper accumulator pod; and the ejector device in hydraulic communication with at least one of the lower accumulator pod and the upper accumulator pod.

9. The package of claim 1, further comprising:

a vent carried by the lower safing assembly and positioned below the lower slips when connected to the well, wherein the vent is operable between an open and a closed position; and a deflector device positioned between the lower slips and the vent, wherein the deflector device is operable to a closed position to divert fluid flow toward the vent.

10. The package of claim 9, wherein the deflector device does not seal against the tubular suspended in the lower safing assembly when in the closed position.

11. The package of claim 1, further comprising:

a vent carried by the lower safing assembly and positioned below the lower slips when connected to the well, wherein the vent is operable between an open and a closed position; and a deflector device positioned between the lower slips and the vent, the deflector device operable to a closed position to divert fluid flow from the well to the vent, wherein the deflector device comprises three rams.

12. A subsea well safing system, comprising:

a safing assembly comprising a lower safing assembly connected to a blowout preventer stack connected to a subsea well and an upper safing assembly connected to a marine riser;

a safing assembly connector in a latched position interconnecting the lower safing assembly and the upper safing assembly providing a bore therethrough in communication with the marine riser and the well, the safing assembly connector operable to an unlatched position thereby disconnecting the upper safing assembly from the lower safing assembly; and an ejector device connected between the upper safing assembly and the lower safing assembly, the ejector device operable to push the upper safing assembly and the lower safing assembly apart and thereby physically separate the upper safing assembly and connected marine riser from the lower safing assembly.

13. The system of claim 12, wherein the safing assembly further comprises:

lower slips operable to engage a tubular suspended in the bore of the lower safing assembly;

upper slips operable to engage the tubular suspended in the bore of the upper safing assembly;

a shear located between the lower slips and the upper slips operable to shear the tubular; and a vent in communication with the bore, the vent operable between a closed position and an open position.

14. The system of claim 12, wherein the safing assembly further comprises:

lower slips operable to engage a tubular suspended in the bore of the lower safing assembly;

upper slips operable to engage the tubular suspended in the bore of the upper safing assembly;

a shear located between the lower slips and the upper slips operable to shear the tubular;

a vent in communication with the bore and located between the lower slips and the blowout preventer stack, the vent operable between a closed position and an open position; and a deflector device located in the lower safing assembly between the lower slips and the vent, the deflector device operable to a closed position to divert fluid flow toward the vent.

15. A subsea well safing sequence, the method comprising:

utilizing a safing assembly installed between a blowout preventer stack of a subsea well and a marine riser, the safing assembly comprising a lower safing assembly connected to the blowout preventer stack and an upper safing assembly connected to the marine riser forming a bore between the riser and the blowout preventer stack, wherein the lower safing assembly comprises lower slips and the upper safing assembly comprises upper slips;

securing a tubular suspended in the bore with the lower slips at a position in the lower safing assembly;

securing the tubular with the upper slips at a position in the upper safing assembly;

shearing the tubular in the bore between the position in the lower safing assembly and the position in the upper safing assembly at which the tubular has been secured; and after shearing the tubular, physically separating the upper safing assembly and the connected marine riser from the lower safing assembly connected to the blowout preventer stack.

16. The method of claim 15, wherein physically separating the upper safing assembly from the lower safing assembly comprises actuating an ejector device connected between the upper safing assembly and the lower safing assembly thereby pushing the upper safing assembly and the lower safing assembly apart.

17. The method of claim 15, further comprising disconnecting, prior to physically separating, the upper safing assembly from the lower safing assembly in response to actuating an assembly connector to an open position.

18. The method of claim 15, further comprising prior to securing the tubular, venting pressure from the bore through a vent located in the lower safing assembly between the blowout preventer stack and the position at which the tubular is to be secured in the lower safing assembly.

19. The method of claim 15, further comprising prior to securing the tubular:

venting pressure from the bore through a vent located in the lower safing assembly between the blowout preventer stack and the position at which the tubular is to be secured in the lower safing assembly; and diverting fluid flow from the bore to the vent prior to securing the tubular.

20. The method of claim 19, wherein the diverting fluid flow comprises actuating a shutter ram to a closed position, wherein the shutter ram is located in the lower safing assembly between the vent and the position at which the tubular is to be secured in the lower safing assembly.

* * * * *